US008261679B2

(12) United States Patent
Ihira et al.

(10) Patent No.: US 8,261,679 B2
(45) Date of Patent: Sep. 11, 2012

(54) SEWING MACHINE PROVIDED WITH NEEDLE BAR ROCKING MECHANISM

(75) Inventors: Yuki Ihira, Kakamigahara (JP); Masayuki Iwata, Gifu (JP); Takashi Hirata, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 467 days.

(21) Appl. No.: 12/654,962

(22) Filed: Jan. 11, 2010

(65) Prior Publication Data

US 2010/0224111 A1 Sep. 9, 2010

(30) Foreign Application Priority Data

Mar. 4, 2009 (JP) ..... 2009-050004
Mar. 4, 2009 (JP) ..... 2009-050563
Mar. 4, 2009 (JP) ..... 2009-050564

(51) Int. Cl.
*D05B 3/02* (2006.01)
*D05B 55/14* (2006.01)

(52) U.S. Cl. ..... 112/445; 112/221; 700/137

(58) Field of Classification Search ..... 112/443–449, 112/270, 274–277, 220, 221, 470.01, 470.02; 700/136–138
See application file for complete search history.

(56) References Cited

U.S. PATENT DOCUMENTS

| | | | | |
|---|---|---|---|---|
| 4,858,548 | A * | 8/1989 | Echeverria | 112/443 |
| 6,055,920 | A * | 5/2000 | Hori | 112/443 |
| 6,779,470 | B2 * | 8/2004 | Sakakibara et al. | 112/470.01 |
| 7,325,502 | B2 * | 2/2008 | Konig et al. | 112/475.02 |
| 7,908,027 | B2 * | 3/2011 | Noguchi et al. | 700/136 |
| 2006/0015209 | A1 * | 1/2006 | Schweizer | 700/136 |
| 2007/0263919 | A1 * | 11/2007 | Wentkowski | 382/141 |
| 2009/0205548 | A1 * | 8/2009 | Iwata et al. | 112/457 |

FOREIGN PATENT DOCUMENTS

| | | |
|---|---|---|
| JP | A 54-127753 | 10/1979 |
| JP | U 57-102518 | 6/1982 |
| JP | A 2003-225482 | 8/2003 |

* cited by examiner

*Primary Examiner* — Ismael Izaguirre
(74) *Attorney, Agent, or Firm* — Oliff & Berridge, PLC

(57) ABSTRACT

A sewing machine includes a needle bar to which a needle is attached, a needle bar rocking mechanism which rocks the needle bar, a needle plate having a needle hole through which the needle is passed, an imaging device which images a lower part of the needle bar, a setting section which sets a range of rocking motion of the needle bar based on an image obtained by the imaging device, and a control device which controls the needle bar rocking mechanism based on the range of rocking motion set by the setting section.

14 Claims, 33 Drawing Sheets

SEWING MACHINE PROVIDED WITH NEEDLE BAR ROCKING MECHANISM

CROSS-REFERENCE TO RELATED APPLICATIONS

This application is based upon and claims the benefit of priority from the prior Japanese Patent Application Nos. 2009-50004, 2009-50563 and 2009-50564 all filed on Mar. 4, 2009, the entire contents of which are incorporated herein by reference.

BACKGROUND

1. Technical Field

The present disclosure relates to a sewing machine provided with a needle bar rocking mechanism which rocks a needle bar.

2. Description of the Related Art

Household sewing machines are generally provided with a needle bar rocking mechanism which is driven by a stepping motor serving as a drive source to rock a needle bar right and left, so that zigzag stitches can be formed on a workpiece cloth while the needle bar is rocked right and left. In this case, a needle plate is formed with a needle hole which is elongate in the right-left direction according to the rocking of the needle bar. Other than the zigzag stitches, the needle bar (a needle) is moved by a predetermined amount leftward from a middle baseline serving as a reference position to a left baseline or rightward from the middle baseline to a right baseline, so that a sewing operation is then carried out.

The aforesaid right and left baselines are determined so that predetermined clearances are defined between a needle location of a needle and right and left edges of the needle holes respectively. More specifically, the right and left baselines are set at respective predetermined positions so that the needle is prevented from interfering with the needle plate. However, when a sewing machine body is subjected to a large impact such as by falling or a screw has been loosened in a mechanism, there is a possibility that the needle location may be displaced from a normal location. Such displacement of the needle location may result in an undesirable sewing operation. In a serous case, the needle would interfere with the needle plate with the result of breakage of the needle or the like.

In view of the above-described problem, a reference mark is conventionally affixed on a part of the needle hole of the needle plate. The operator visually confirms whether the needle location corresponds with the reference mark. However, the operator cannot visually determine the displacement of the needle location accurately (objectively). As a result, affixing the reference mark is less reliable. In view of the circumstances, an improved sewing machine has been proposed which is provided with a proximity sensor mounted on a connecting rod transmitting a drive force of the stepping motor of the needle bar rocking mechanism to the needle bar, for example. A rocking position of the needle bar is detected by the proximity sensor so that an amount of rock of the needle bar is adjusted based on the detected rocking position.

In the above-described construction, however, the rocking position of the needle relative to the needle hole is detected in an indirect manner based on the detection of a detected part of the connecting rod by the proximity sensor. This indirect detecting manner results in a difficulty in an accurate detection of the rocking position of the needle relative to the needle hole.

SUMMARY

Therefore, an object of the disclosure is to provide a sewing machine in which the needle bar rocking mechanism can be controlled so that the needle location of the needle attached to the needle bar is rendered appropriate.

The present disclosure provides a sewing machine comprising a needle bar to which a needle is attached, a needle bar rocking mechanism which rocks the needle bar, a needle plate having a needle hole through which the needle is insertable, a photographing device which photographs a lower part of the needle bar, a setting section which sets a range of rocking motion of the needle bar based on a photographic image obtained by the photographing device, and a control device which controls the needle bar rocking mechanism based on the range of rocking motion set by the setting section.

The disclosure also provides a sewing machine comprising a needle bar to which a needle is attached, a needle bar rocking mechanism which rocks the needle bar, a needle plate having a needle hole through which the needle is insertable, a photographing device which photographs a lower part of the needle bar, an extracting section which extracts contour images of the needle hole and the needle based on a photographic image obtained by the photographing device, and a control device which controls a range in which the needle bar is allowed to be rocked by the needle bar rocking mechanism, based on the contour images extracted by the extracting section.

The disclosure further provides a sewing machine comprising a needle bar to which a needle is attached, a needle bar rocking mechanism which rocks the needle bar, a needle plate having a needle hole through which the needle is insertable, a button presser foot which holds a button below the needle bar, a photographing device which photographs a plurality of holes formed in the button, a recognizing section which recognizes positions of at least two of the plural needle holes, based on a photographic image obtained by the photographing device, a setting section which sets a rocking position of the needle bar so that the needle is penetrated through said at least two needle holes, based on the locations of the holes recognized by the recognizing section, and a control device which controls the needle bar rocking mechanism based on the rocking position of the needle bar set by the setting section.

DETAILED DESCRIPTION OF THE DISCLOSURE

Figure 1:
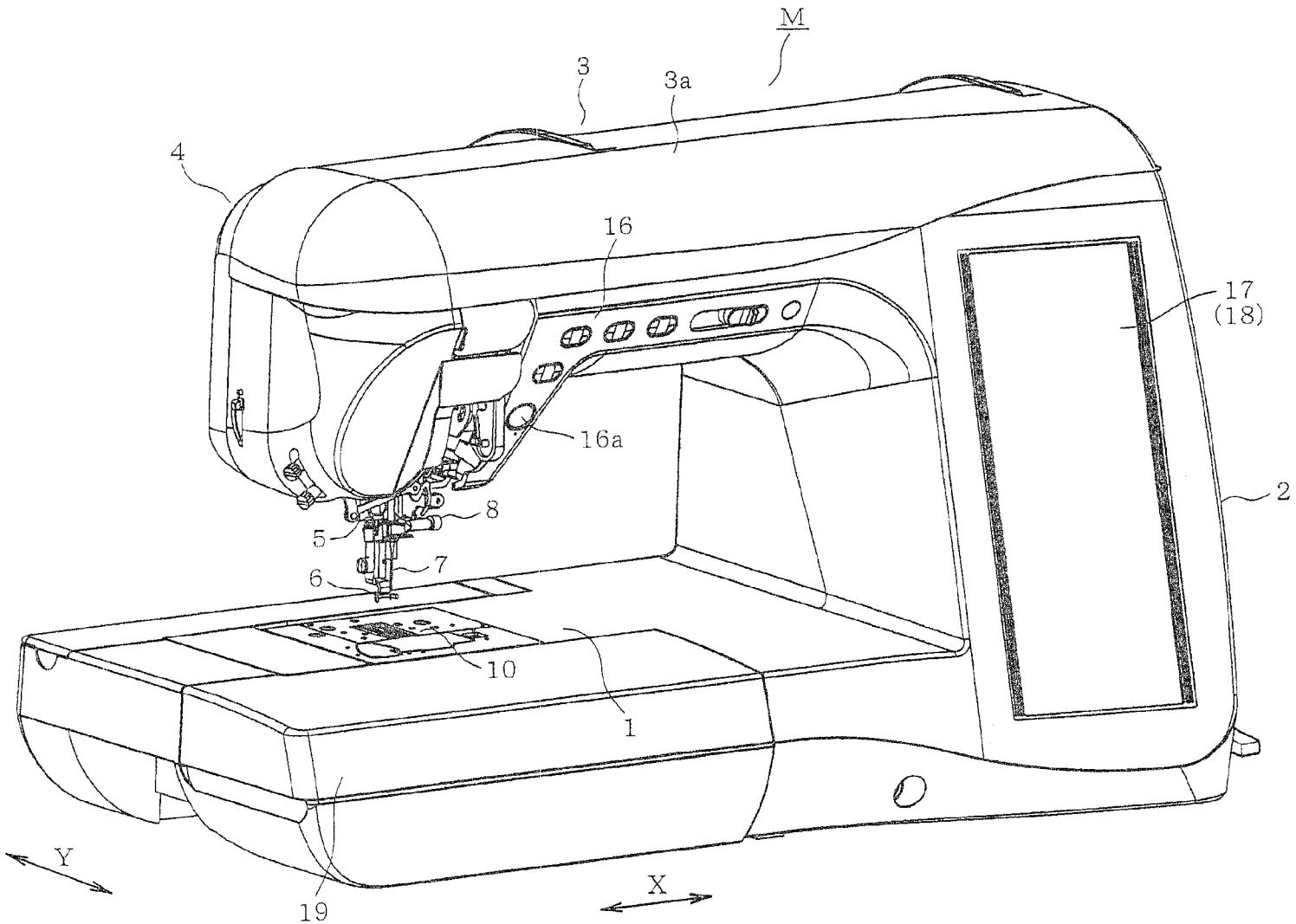
FIG. 1 is a perspective view of a sewing machine in accordance with one illustrative example of the disclosure.

A first example of the present disclosure will be described with reference to FIGS. 1 to 11. Referring to FIG. 1, a sewing machine M includes a body which includes a sewing bed 1 extending in a right-left direction (X direction), a sewing pillar 2 extending upward from a right end of the bed 1 and a sewing arm 3 extending leftward from an upper end of the pillar 2, all of which are formed integrally. A sewing head 4 is mounted on a distal end of the arm 3. The bed 1 has an upper side on which a cover 3*a* is mounted so as to be openable and closable. The cover 3*a* covers a thread spool accommodating part (not shown) for accommodating a thread spool (not shown). In the following description, the user is assumed to be located at the front of the multineedle sewing machine M and the opposite side of the sewing machine will be referred to as "the rear." Furthermore, the side of the sewing machine M where the pillar 2 is located will be referred to as "right" and the opposite side of the sewing machine M will be referred to as "left."

Figure 2:
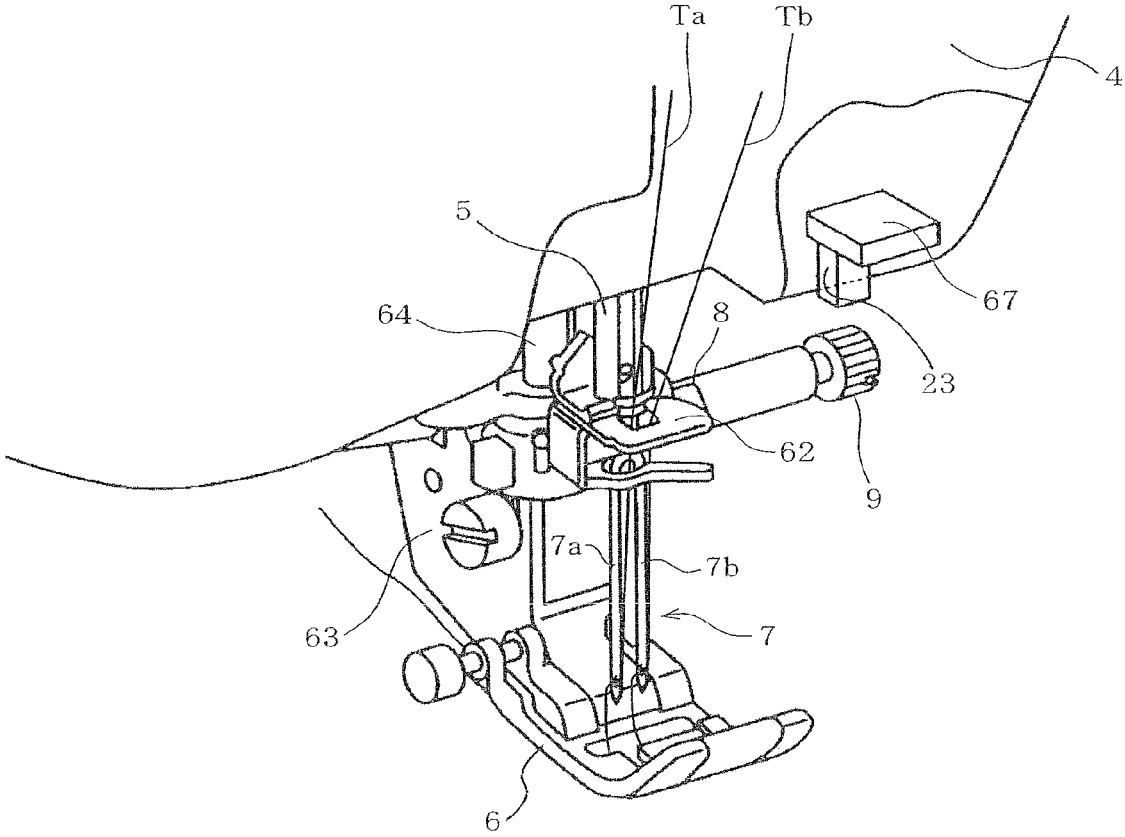
FIG. 2 is an enlarged perspective view of a needle and periphery thereof.

Referring to FIG. 2, the head 4 mounted on the distal end of the arm 3 is provided with a needle bar 5 which is rockable in the upward-downward direction and in the right-left direction. The needle bar 5 is supported by a needle bar base 45. The needle bar 5 has a lower end to which a sewing needle is attached via a needle clamping member 8.

Figure 3:
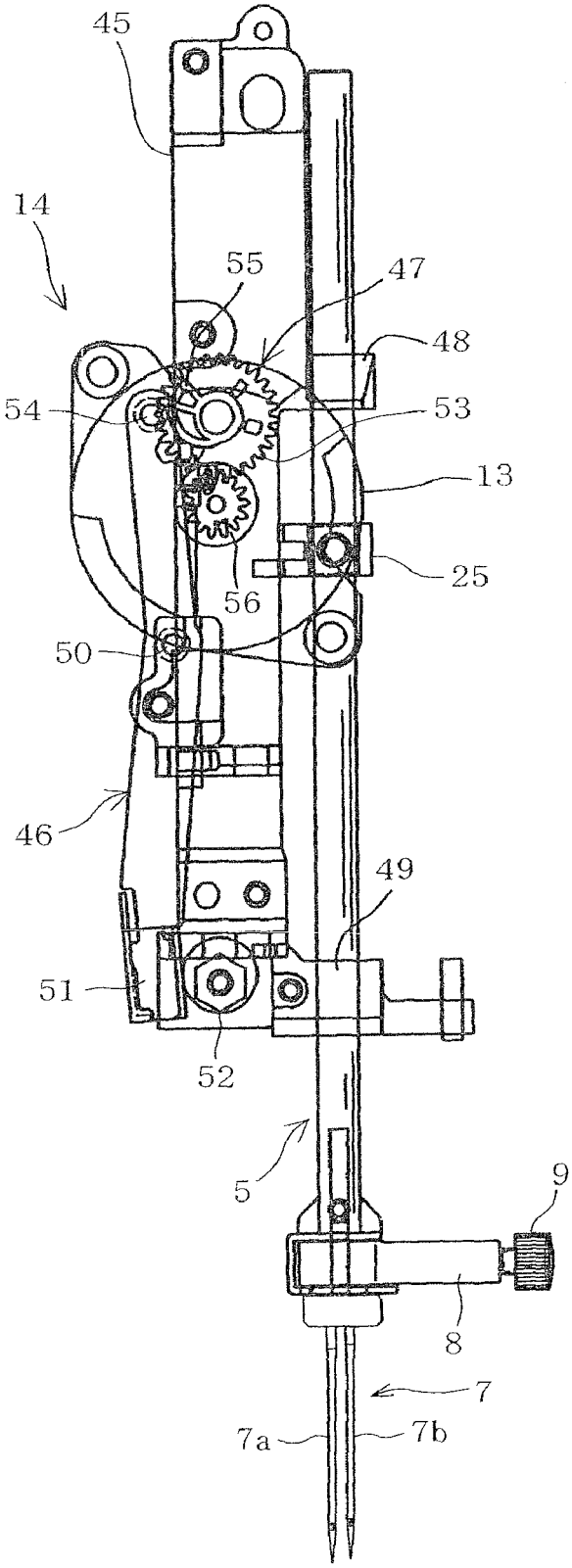
FIG. 3 is a front view of a needle bar rocking mechanism.
Figure 4:
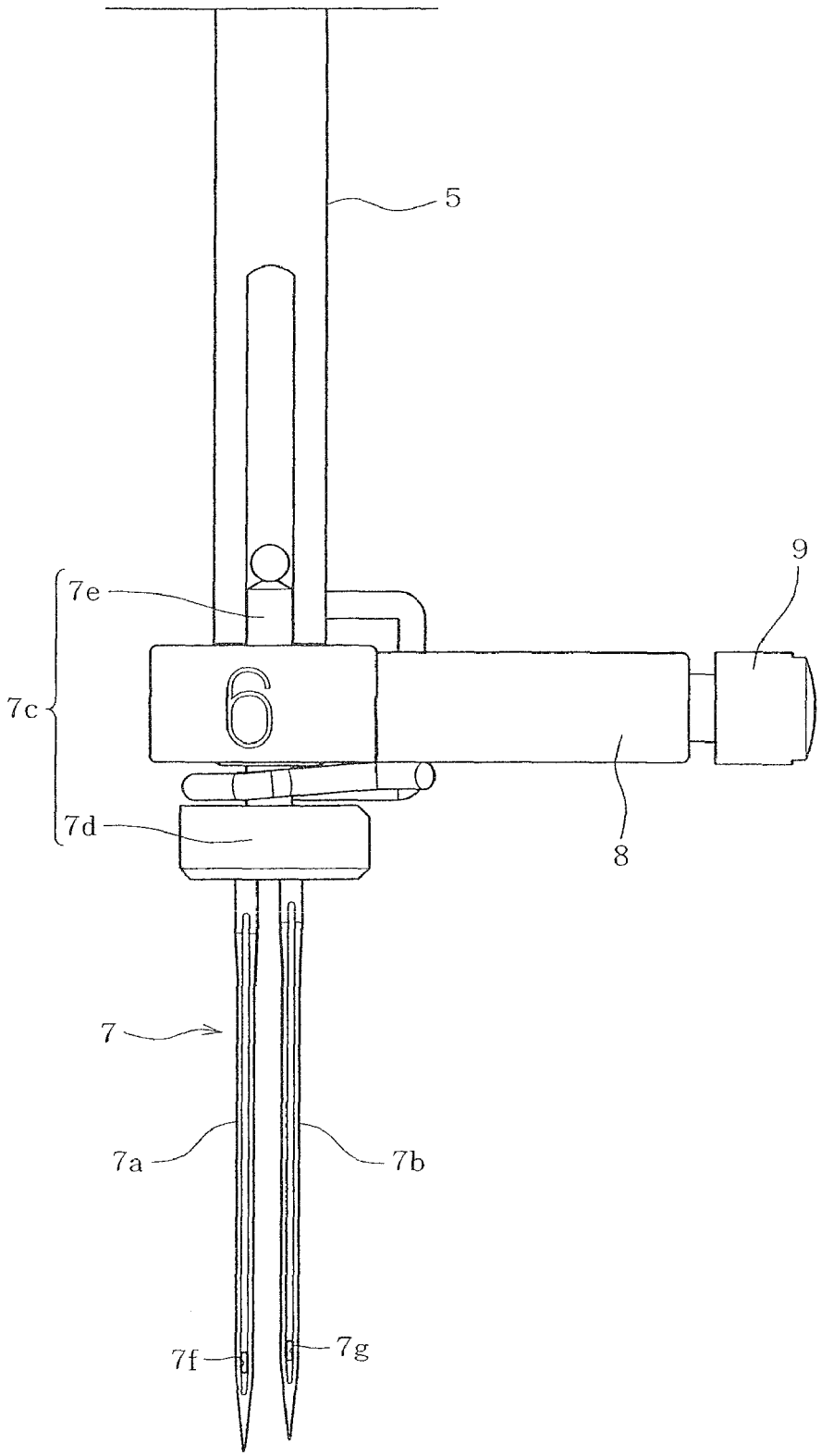
FIG. 4 is an enlarged front view of the needle bar to which a twin needle is attached.

The needle will be described in detail. A plurality of types of general needles having different widths (single needles) are attachable to the needle bar 5 or usable with the sewing machine M and are prepared. Furthermore, a twin needle 7 having a plurality of (two) needles is attached as a standard item as shown in FIGS. 2 to 4 and 7. The twin needle 7 has two integral needles 7*a* and 7*b* extending downward from a lower part of a mounting base 7*c* with a predetermined spacing therebetween so as to be substantially symmetrical in the right-left direction as shown in FIG. 4. The needles 7*a* and 7*b* have respective needle eyes 7*f* and 7*g* which have slightly different vertical positions due to the timing of encounter with a horizontal hook (not shown) as will be described latex. The needles 7*a* and 7*b* also have respective distal ends which have slightly different vertical positions due to the encounter timing. The mounting base 7*c* includes a needle support portion 7*d* and a shaft-like attachment portion 7*e* both of which are formed integrally therewith. The needle support portion 7*d* fixes and supports the needles 7*a* and 7*b*. The attachment portion 7*e* extends upward from the needle support portion 7*d* and is attached to the needle bar 5 by the needle clamping member 8. The needles 7*a* and 7*b* are supported so as to be located in bilateral symmetry about a central axis of the attachment portion 7*e* or of needle bar 5. Some types of twin needles have two needles which are supported so as not to be located in bilateral symmetry about the central axis of the attachment portion 7*e* although the arrangement is not shown. When the twin needle 7 is attached to the needle bar 5 and two needle threads Ta and Tb (needle threads of different colors, for example) are set through the respective needle eyes 7*f* and 7*g*, a sewing operation is carried out so that two stitch lines are formed with a predetermined distance therebetween by the needle threads Ta and Tb on a workpiece cloth, as shown in FIG. 2.

Regarding the twin needle 7 employed in the example, the needles 7*a* and 7*b* have the spacing of 3 mm therebetween and each needle has a width of 0.9 mm, for example. However, since twin needles having different spacings and different widths are commercially available, there is a possible case where the user uses a twin needle other than the originally equipped one. In view of the case, twin needles each of which has a spacing and needle width differing from the originally equipped twin needle 7 can be used with the sewing machine M without trouble in the example.

A needle locking screw 9 is provided on a right end of the needle clamping member 8, so that the user can attach and detach (change) the needle by turning the needle locking screw 9, as shown in FIG. 2. A presser foot 6 is mounted on the head 4 so as to be located below the needle bar 5. The workpiece cloth is pressed onto the needle plate 10 by the presser foot 6. The presser foot 6 is detachably attached to a presser holder 63 located on the lower end of a presser bar 64 provided in the rear of the needle bar 5. A threading device is provided on the left of the needle bar 5 in order that the needle threads Ta and Tb having been passed through a needle bar guide 62 may further be passed through the needle eyes 7*f* and 7*g* of the twin needle 7 respectively although not shown.

A sewing machine main shaft is provided in the arm 3 so as to be rotated by a sewing machine motor 12 (see FIG. 6) although not shown. Furthermore, a needle bar driving mechanism and a needle bar rocking mechanism (see FIG. 3) 14 are provided in the arm 3. The needle bar driving mechanism moves the needle bar 5 upward and downward by the drive force of the main shaft. The needle bar rocking mechanism 14 includes a stepping motor 13 (see FIGS. 3 and 6) and rocks the needle bar 5 in the right-left direction (X direction) with the stepping motor 13 serving as a driving source. The needle bar rocking mechanism 14 will be described in detail later. In the arm 3 are further provided a needle thread take-up driving mechanism which moves a needle thread take-up (not shown) upward and downward in synchronization with the needle bar 5 and a thread tension device which adjusts a tension applied to the needle thread, and the like, none of which are shown.

A sectorial shutter (closure plate) is mounted on the main shaft so as to be rotated with the main shaft although not shown. A photointerrupter (not shown) is mounted on a sewing machine frame (not shown) to optically detect a rotating state of the shutter. The shutter and the photointerrupter constitute a main shaft angle detector 15 (see FIG. 6). An angle of the main shaft is detected by the main shaft angle detector 15 with the result that a vertical position of the needle bar 5 driven in the vertical direction by the main shaft can be determined. When the user operates a start/stop key 16*a* to stop a sewing work, the needle bar 5 is set so as to be stopped at a needle-up position or substantially at an uppermost position of the vertical movement.

A plurality of key switches 16 are provided on the front of the arm 3 and include a start/stop key 16*a* instructing start and stop of sewing work, a reverse stitching key, a needle-up key, a thread cutting key and a speed adjusting knob, as shown in FIG. 1. A large-sized vertically long liquid crystal display 17 which is capable of color display is provided on the front of the pillar 2. A number of stitch patterns including ordinary stitches and embroidery patterns, names of functions to be executed in a sewing work, various messages, information and the like. Furthermore, a touch panel 18 (see FIG. 6) is provided on the surface of the liquid crystal display 17. A desired stitch pattern is selected on the touch panel 18 so that one or more necessary functions are executed. In this case, the liquid crystal display 17 is designed so as to display an error message (warning) when it has been determined that the twin needle 7 is in an abnormal condition. The liquid crystal display 17 thus constitutes a part of an alarm device.

Figure 5:
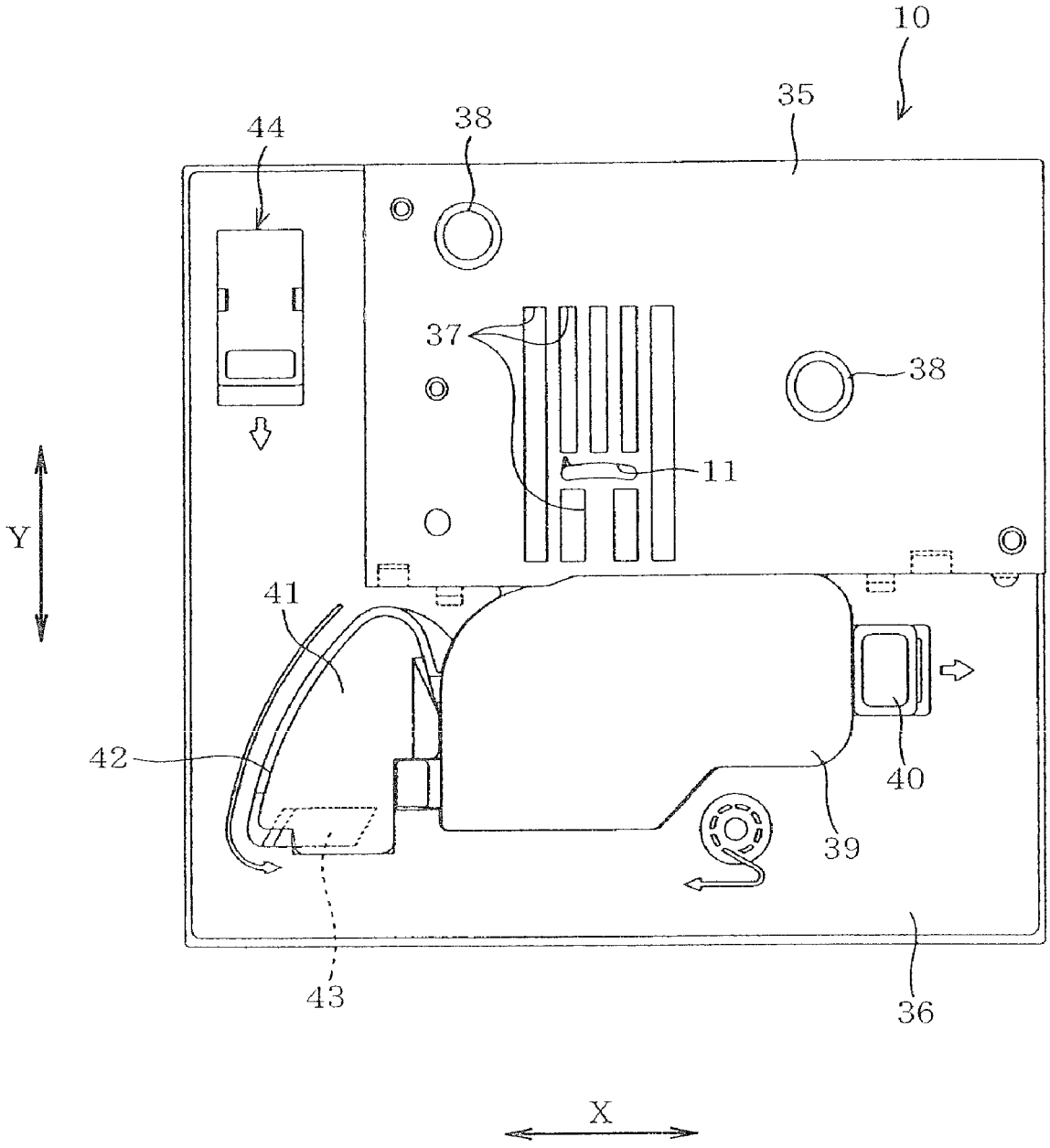
FIG. 5 is a plan view of a needle plate.

The needle plate 10 is mounted on the upper surface of the bed 1 as shown in FIGS. 1 and 5. In the bed 1 are provided a feed dog driving mechanism which is located below the needle plate 10 to drive a feed dog in synchronization with the vertical movement of the needle bar 5, a horizontal rotary hook which accommodates a bobbin and forms stitches in cooperation with the twin needle 7, a thread cutting mechanism which cuts needle and bobbin threads, and the like, none of which are shown. An ordinary sewing table 19 is detachably attached to the left front of the bed 1 as shown in FIG. 1.

Figure 6:
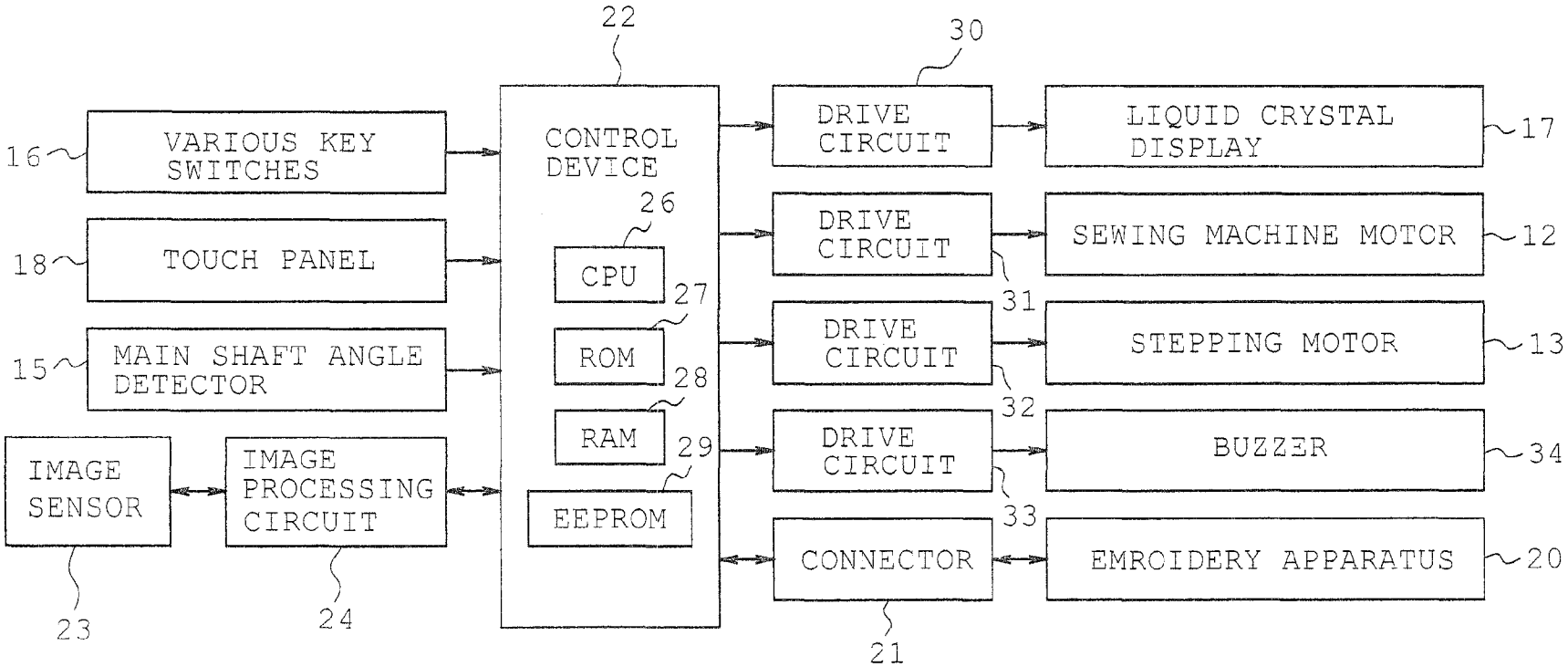
FIG. 6 is a block diagram showing an electrical arrangement of the sewing machine.

A known embroidering apparatus (embroidery frame moving apparatus) 20 is detachably attached to the left part of the bed 1 with the table 19 having been detached as shown in FIG. 6. The embroidering apparatus 20 is designed so as to move an embroidery frame holding a workpiece cloth freely in the X direction (the right-left direction) and in the Y direction (the front-rear direction) perpendicular to the X direction on the bed 1 (the needle plate 10). The embroidering apparatus 20, when attached to the bed 1, is electrically connected via a connector 21 (shown only in FIG. 6) provided on the bed 1 to a control device 22 (control unit) of the sewing machine.

The needle plate 10 is formed into a generally rectangular shape and includes a first needle plate 35 which is made of a metal and is fixed to the bed 1 and a second needle plate 36 which is made of a synthetic resin and detachably attached to the first needle plate 35, as shown in FIG. 5. The first needle plate 35 is formed with a through needle hole 11 through which the twin needle 7 is allowed to pass and a plurality of, for example, seven, rectangular through holes 37 through which the feed dog is allowed to appear and disappear. The needle hole 11 is elongate in the right-left direction according to the rocking movement of the needle bar 5 (the twin needle 7). The rectangular holes 37 are each formed into an elongate shape in the front-rear direction and disposed so as to encompass the needle hole 11.

On the other hand, a transparent needle plate cover 39 made of a synthetic resin is detachably attached to the second needle plate 36 so as to cover a bobbin accommodating hole (not shown) from above. Furthermore, a guide groove 42 for guiding a bobbin thread and a cutting blade 43 for cutting the bobbin thread are provided on an upper surface of the second needle plate 36 so as to be located on the left of the needle plate cover 39.

The needle bar rocking mechanism 14 rocking the needle bar 5 in the right-left direction or in the X direction will now be described. The needle bar base 45 supporting the needle bar 5 has an upper end which is pivotally mounted on a sewing machine frame (not shown) in the head 4, whereby the needle bar 5 is rockable in the right-left direction, as shown in FIG. 3. The needle bar 5 is supported by upper and lower supporting portions 48 and 49 provided on the right side of the needle bar base 45, so as to be movable upward and downward. The needle bar 5 has substantially a middle portion which is located between the supporting portions 48 and 49 and connected to the needle bar rocking mechanism by a needle bar connecting stud 25 to the needle bar driving mechanism.

The needle bar rocking mechanism 14 includes the needle-bar base 45, a rocking lever 46, the stepping motor 13 and a rocking cam 47 rotated by the stepping motor 13, all of which are mounted on the sewing machine frame. The rocking lever 46 extends in the vertical direction substantially in parallel to the needle bar base 45 and has a substantially vertically middle portion mounted on a pivot pin 50 further mounted on the sewing machine frame so that the needle bar base 45 is rockable. The rocking lever 46 has a lower end 51 abutting a cam member 52 fixed to the lower end of the needle bar base 45 and an upper end to which a pin 54 is secured. The pin 54 abuts a cam face 55 of the rocking cam 47 which rocks the needle bar base 45 in the right-left direction. The lower end 51 of the rocking lever 46 is urged leftward by a spring (not shown) so that the pin 54 and the cam face 55 are retained in an abutting state.

Figure 7:
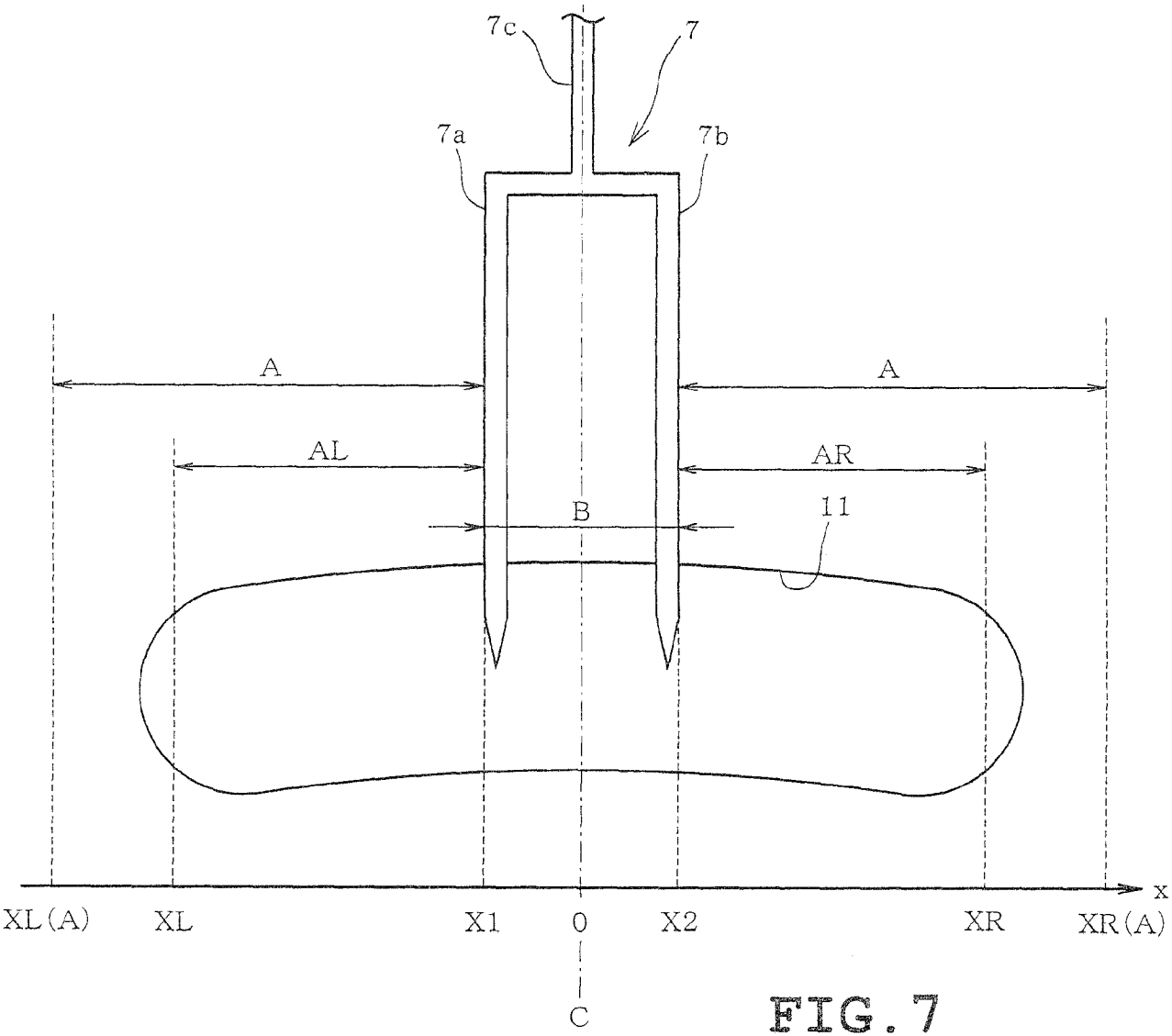
FIG. 7 shows a positional relationship between a needle hole and the needle bar.

The stepping motor 13 fixed to the sewing machine frame has an output shaft on which a driving gear 56 is mounted and is in mesh engagement with a peripheral gear 53 of the rocking cam 47. The cam face 55 of the rocking cam 47 has a radius increased cam face with a longer distance from the axis of rotation and a radius reduced cam face with a shorter distance from the axis of rotation, both of which are continuous with each other. As the result of the above-described construction, the central axis of the needle bar 5 is perpendicular to the upper surface of the needle plate 10 when the stepping motor 13 assumes a reference position (an origin position). In this state, the vertical movement of the needle bar 5 moves the twin needle 7 vertically through the central part of the needle hole 11 of the needle plate 10 as shown in FIG. 7. This position of the twin needle 7 is referred to as "central needle position C."

On the other hand, when the stepping motor 13 is driven by positive-direction pulses, for example, the swinging cam 47 is rotated so that the upper end of the swinging lever 46 is moved leftward. Accordingly, since the lower end 51 of the swinging lever 46 is moved rightward, the needle bar base 45 is moved rightward together with the needle bar 5. When the stepping motor 13 is driven by negative-direction pulses, the swinging cam 47 is rotated so that the upper end of the swinging lever 46 is moved rightward. Accordingly, since the lower end 51 of the swinging lever 46 is moved leftward, the needle bar base 45 is moved leftward together with the needle bar 5. An amount of swing of the needle bar 5 in each of the right and left directions depends upon the number of pulses to be applied.

Thus, the sewing machine M can perform sewing of zigzag patterns by swinging the needle bar 5 (the twin needle 7) right and left with a predetermined needle drive width by the needle bar swinging mechanism 14. In this case, when selecting a zigzag pattern on the touch panel 18, the user can set a needle drive width. More specifically, a standard needle drive width is automatically set when the user selects a zigzag pattern. When wishing to change the standard needle drive width, the user operates to increase or decrease the standard value.

An image sensor 23 is mounted via a support frame 67 on a lower front end of the head 4 so as to be located obliquely forwardly upward with respect to the twin needle 7 as shown in FIG. 2. The image sensor 23 serves as a photographing device which photographs the twin needle 7 and the needle hole 11. The image sensor 23 comprises a small imaging device of the complementary metal-oxide semiconductor (CMOS) type in the example. When the sewing operation is stopped, the needle bar 5 is stopped at the needle-up position which is located higher than the needle plate 10. Accordingly, the twin needle 7 and the needle hole 11 are imaged by the image sensor 23 when the needle bar 5 has been moved to the needle-down position (substantially lowermost position in the vertical movement) as will be described later.

The control device 22 is mainly composed of a microcomputer and includes a CPU 26, a ROM 27, a RAM 28 and an EEPROM 29. The ROM 27 stores a control program for controlling the sewing operation, data of stitches necessary for the sewing operation. The ROM 27 also stores a program for determining positional displacement of the needle bar 5 and data for the determination, for example, data of normal positions of the needle bar 5 at the right, central and left positions (for example, spacing from the left end of the needle hole 11, which will be referred to as "normal position data") and the like.

Various key switches 16 including the start/stop key 16*a* and the touch panel 18 are connected to the control device 22 so that operation signals are delivered to the control device 22. The main shaft angle detector 15 is also connected to the control device 22 so that a detection signal indicative of the result of detection is delivered to the control device 22. Furthermore, an image processing circuit 24 is connected to the control device 22 so that the image sensor 23 is controlled by the control device 22 and so that the contour images of the twin needle 7 and the needle hole 11 are delivered from the image processing circuit 24 to the control device 22.

The liquid crystal display 17, the sewing machine motor 12 and the stepping motor 13 are connected via drive circuits 30, 31 and 32 to the control device 22 respectively so that the control device 22 controls these display and motors for execution of a sewing operation. Furthermore, a warning buzzer 34 is connected via a drive circuit 34 to the control device 22. A connector 21 is also connected to the control device 22. When a zigzag pattern is sewn, the control device 22 determines whether the twin needle 7 has been attached to the needle bar 5, by the software configuration hereof (execution of needle recognition and a needle drive control program). When the twin needle 7 is attached to the needle bar 5, the control device 22 limits the needle drive width according to the spacing of the twin needle.

In this case, the control device 22 extracts contour images of the needle hole 11 and the needles 7*a* and 7*b* based on the images taken by the image sensor. The control device 22 then calculates the spacing between the needles 7*a* and 7*b* based on the extracted contour images. The control device 22 controls an allowable range of swing of the needle bar 5 by the needle bar swinging mechanism 14 according to the calculated spacing. Accordingly, the control device 22 (and the image processing device 24) serves as an extracting section, a spacing calculating section, and a rocking range control device.

More specifically, the control device 22 controls the image sensor 23 so that images of the twin needle 7 and the needle hole 11 are taken in by the image sensor 23 before the sewing operation of the sewing machine M actually starts. Based on the image data, the control device 22 then controls the image processing circuit 24 so that the contour images of the twin needle 7 and the needle hole 11 are extracted by the image processing circuit 24. The control device 22 then calculates the spacing between the needles 7*a* and 7*b* of the twin needle based on the contour images of the twin needle 7 and the needle hole 11. The control device 22 then sets an upper limit value of the needle drive width according to the calculated spacing and compares the set upper limit value with the currently set needle drive width. When the currently set needle drive width is excessively larger than the upper limit value, the control device 22 corrects the needle drive width of the twin needle 7 so that the needle drive width is reduced. In this case, the control device 22 may inform the user of an error that the needle drive width exceeds the upper limit value and be in standby for an operation to change the needle drive width by the user (or change of the twin needle etc).

Referring now to FIG. 7, the right direction of the X axis denotes a positive direction, and the center of the needle hole 11 in the right-left direction (a central position) is denoted as the zero point (origin) on the X coordinate. Coordinate XL (<0) denotes a position spaced rightward from a left end of the needle hole 11 by a predetermined distance (0.5 mm, for example). Coordinate XR (>0) denotes a position spaced leftward from a right end of the needle hole 11 by a predetermined distance (0.5 mm, for example). The aforesaid spacing is set so as to prevent interference between the twin needle 7 and the needle hole 11. Point XL (A) denotes the destination of the needle 7*a* in the case where the needle 7*a* is rocked leftward by a needle drive width A. Point XR(A) denotes the destination of the needle 7*b* in the case where the needle 7*b* is rocked rightward by the needle drive width A. The aforesaid allowable range of swing of the needle bar 5 is represented as a distance from point XL (A) to point XR (A).

In the example, a right drive width limit value AR and a left drive width limit value AL of the twin needle 7 are calculated based on a width B between outer ends of the needle 7*a* and 7*b*, obtained from the above-described contour images, as shown in FIG. 7. The allowable range of swing of the needle bar 5 is limited by the right and left drive width limit values AR and AL. Consequently, the needles 7*a* and 7*b* can be prevented from interfering with the needle plate 10 (see FIG. 5) even when the twin needle 7 attached to the needle bar 5 takes any value of width B. The needle bar 5 normally assumes a position (an initial position) denoted as the zero point (origin) on the X coordinate, that is, a central needle position, immediately after power-on of the sewing machine M irrespective of a selected stitch pattern.

The working of the sewing machine M thus constructed will be described with reference to FIGS. 8 to 11. The following twin needle recognizing process may be executed every immediately after the sewing machine M is powered on or when the user operates a key.

Figure 8:
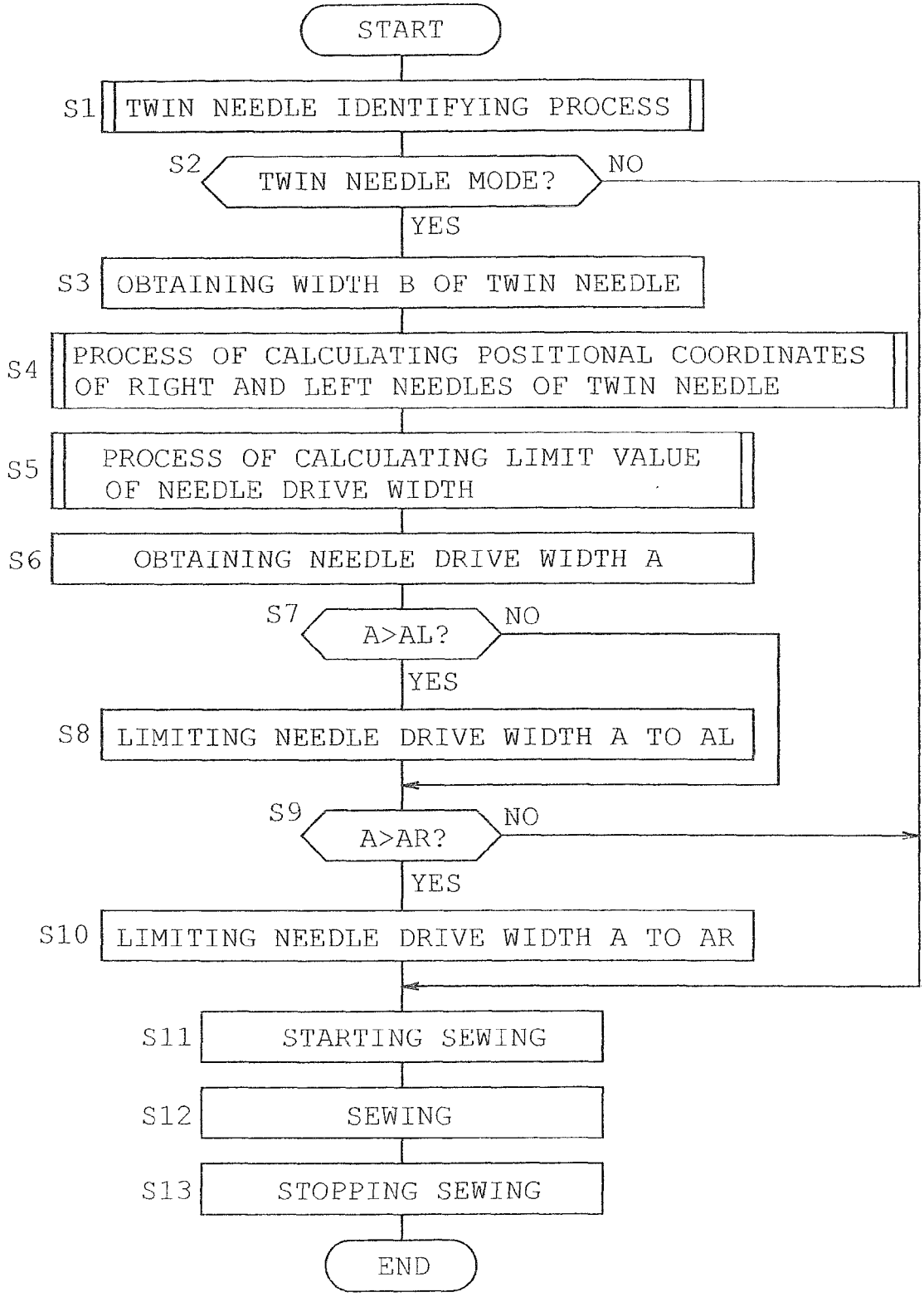
FIG. 8 is a flowchart showing an overall procedure executed by a control device in use of the sewing machine.
Figure 9:
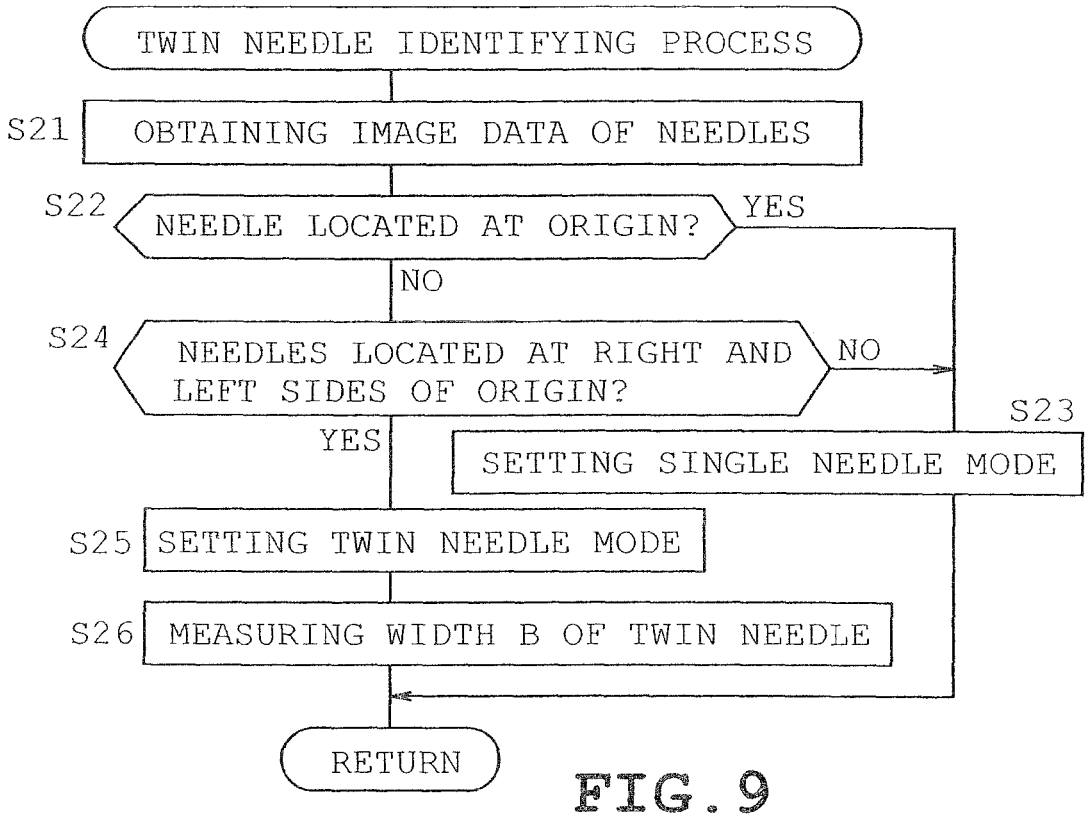
FIG. 9 is a flowchart showing in detail a twin-needle recognizing process as shown in FIG. 8.

Referring to FIG. 8, the control contents (main routine) executed by the control device 22 at the time of power-on of the sewing machine M is shown. Firstly, the twin needle recognizing process is carried out based on image data obtained by the image sensor 23 (see FIGS. 2 and 6) at step S1 as shown in FIG. 9. In the process, the control device 22 determines whether a needle attached to the needle bar 5 is a twin needle. When the needle is a twin needle, the width B (see FIG. 7) of the twin needle is calculated. More specifically, the image data of the needle attached to the needle bar 5 is obtained by the image sensor 23 at step S21 in FIG. 9. The obtained image data is converted to a contour image of the needle by the image processing circuit (see FIG. 6).

The control device 22 determines whether the needle assumes the origin on the X coordinate, based on the contour image of the needle at step S22. Since the needle bar 5 is located at the origin on the X coordinate immediately after power-on of the sewing machine M, the control device 22 determines that the needle attached to the needle bar 5 assumes the origin (S22: YES) and further that the needle is a single needle. In this case, the control device 22 sets a single needle mode at step S23, returning to the main routine of FIG. 8. When determining at step S2 in the negative, the control device 22 advances to step S11. When the user operates the start/stop key 16*a*, sewing is started at step S11, and a zigzag pattern is sewn by the single needle at step S12. Upon termination of the sewing, the user operates the start/stop key 16*a* to stop the sewing operation (step S13).

The control device 22 then returns to the twin needle recognizing process in FIG. 9. When determining at step S22 that the needle does not assume the origin on the X coordinate (S22: NO), the control device 22 advances to step S24 to determine whether the needles are located at right and left sides of the origin on the X coordinate, based on the contour image. When the needles are not located at the right and left sides of the origin (S24: NO), the control device 22 advances to step S23 to set the single needle mode, further advancing to step S2 to carry out the subsequent process in the same manner as described above.

When the needles are located at the right and left sides of the origin on the X coordinate (S24: YES), the control device 22 advances to step S25 to set the twin needle mode. The control device to step S26 to measure the width B (see FIG. 7) of the twin needle 7, based on the contour image. Thereafter, the control device 22 returns to the main routine of FIG. 8. Since the twin needle mode is set this time (S2: YES), the control device 22 advances to step S3.

Figure 10:
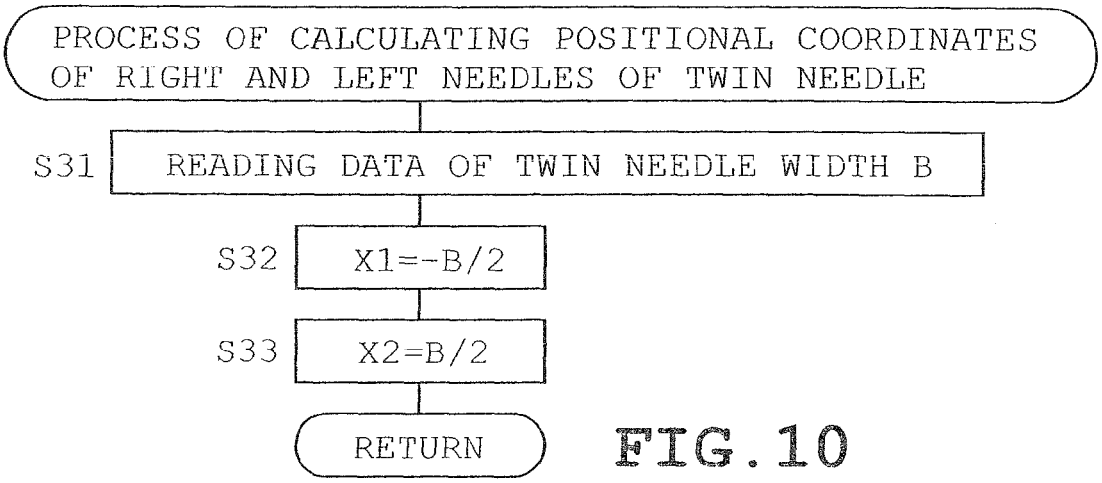
FIG. 10 is a flowchart showing in detail a process of calculating coordinates of right and left needle positions of the twin needle as shown in FIG. 8.

At step S3, the control device 22 obtains the width B of the twin needle 7 measured at step S20 (see FIG. 9), thereafter advancing to step S4 to carry out a process of calculating an X coordinates of the needles 7*a* and 7*b* of the twin needle 7. As shown in the flowchart of FIG. 10, the width B of the twin needle 7 is read at step S31 firstly. The control device 22 then advances to step S32 to calculate the X coordinate X1 of the left needle 7*a*, which coordinate X1 is obtained as X1=−B/2 (<0). Next, the control device 22 advances to step S33 to calculate the X coordinate X2 of the right needle 7*b*, which coordinate is obtained as X2=−B/2 (>0).

Figure 11:
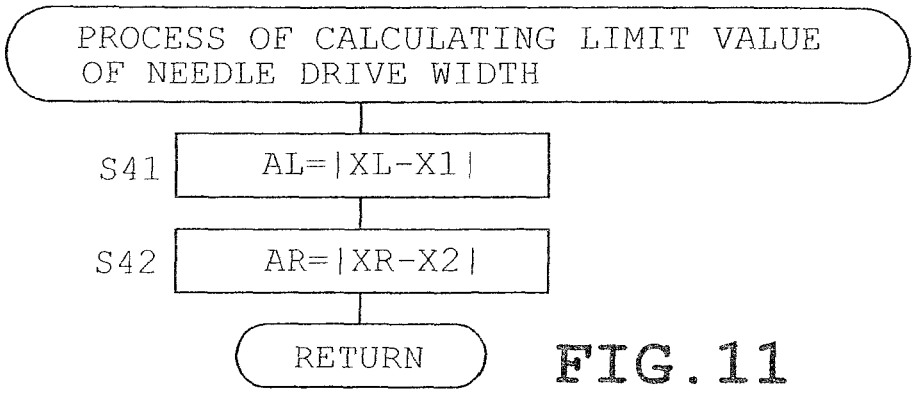
FIG. 11 is a flowchart showing in detail a process of calculating a needle rocking width limit value as shown in FIG. 8.

When returning to the main routine of FIG. 8, the control device 22 carries out a process of calculating a needle drive width limit value of the twin needle 7 at step S5, thereby obtaining rightward and leftward movable ranges of the twin needle 7. As shown in the flowchart of FIG. 11, the left needle drive width limit value AL (see FIG. 7) of the twin needle 7 is obtained as AL=|XL−X1| at step S41. The right needle drive width limit value AR is obtained as AR=|XR−X2| at step S42.

When returning to the main routine of FIG. 8, the control device 22 obtains a needle drive width A of a stitch to be sewn at step S6. The control device 22 then advances to step S7 to determine whether the needle drive width A is larger than the left needle drive width limit value AL. In the case where the needle drive width A is equal to or smaller than the left needle drive width limit value AL at step S7 (S7: NO), the needle 7*a* does not interfere with the needle plate 10 even when the twin needle 7 is rocked at the needle drive width A (see FIG. 7). The control device 22 then advances to step S9 to determine whether the needle drive width A is larger than the right needle drive width limit value AR. In the case where the needle drive width A is equal to or smaller than the right needle drive width limit value AR (S9: NO), the needle 7*b* does not interfere with the needle plate 10 even when the twin needle 7 is rocked at the needle drive width A (see FIG. 7). Subsequently, the control device 22 carries out processes at the above-described steps S11 to A13.

On the other hand, when the needle drive width A is larger than the left needle drive width limit value AL (S7: YES), the control device 22 advances to step S8 to reduce the needle drive width A of the stitch to the left needle drive width limit value AL. When determining at step S9 that the needle drive width A is larger than the right needle drive width limit value AR (S9: YES), the control device 22 advances to step S10 to reduce the needle drive width A of the stitch to the right needle drive width limit value AR, whereby the needle drive width of the needle bar 5 is limited to the right needle drive width limit value AR. Thereafter, the control device 22 advances to step S11 to start sewing when the user has operated the start/stop key 16*a*. The control device 22 further advances to step S12 where sewing of a zigzag pattern is carried out by the single needle by the single needle. In this case, since the needle drive width A is limited to the right and left needle drive width limit values AR and AL, the needles 7*a* and 7*b* do not interfere with the needle plate 10 even when the twin needle 7 is rocked at the needle drive width A (see FIG. 7). Subsequently, when the user has finished sewing, the sewing machine M is stopped by user's operation of the start/stop key 16*a* (step S13).

The plural needles, that is, the sewing operation by the twin needle 7 is executable in the above-described example. The control device 22 can reliably and automatically determine whether the needle attached to the needle bar 5 is a single needle or the twin needle 7, based on the contour images of the twin needle 7 and the needle hole 11 extracted by the image processing circuit 24 from the image taken by the image sensor 23. Furthermore, the actual positional relation between the needle hole 11 and the twin needle 7 can be detected directly based on the aforesaid images, and the width B between the needles 7*a* and 7*b* can also be detected directly based on the aforesaid images. The needle drive width A in the sewing of zigzag pattern can be limited so that the twin needle 7 and the needle plate 10 are prevented from interfering with each other. Accordingly, even when any type of twin needle is used in the sewing of the zigzag pattern, defect such as the interference between the needles 7*a* and 7*b* of the twin needle 7 and the needle plate 10 can reliably be prevented.

Figure 12:
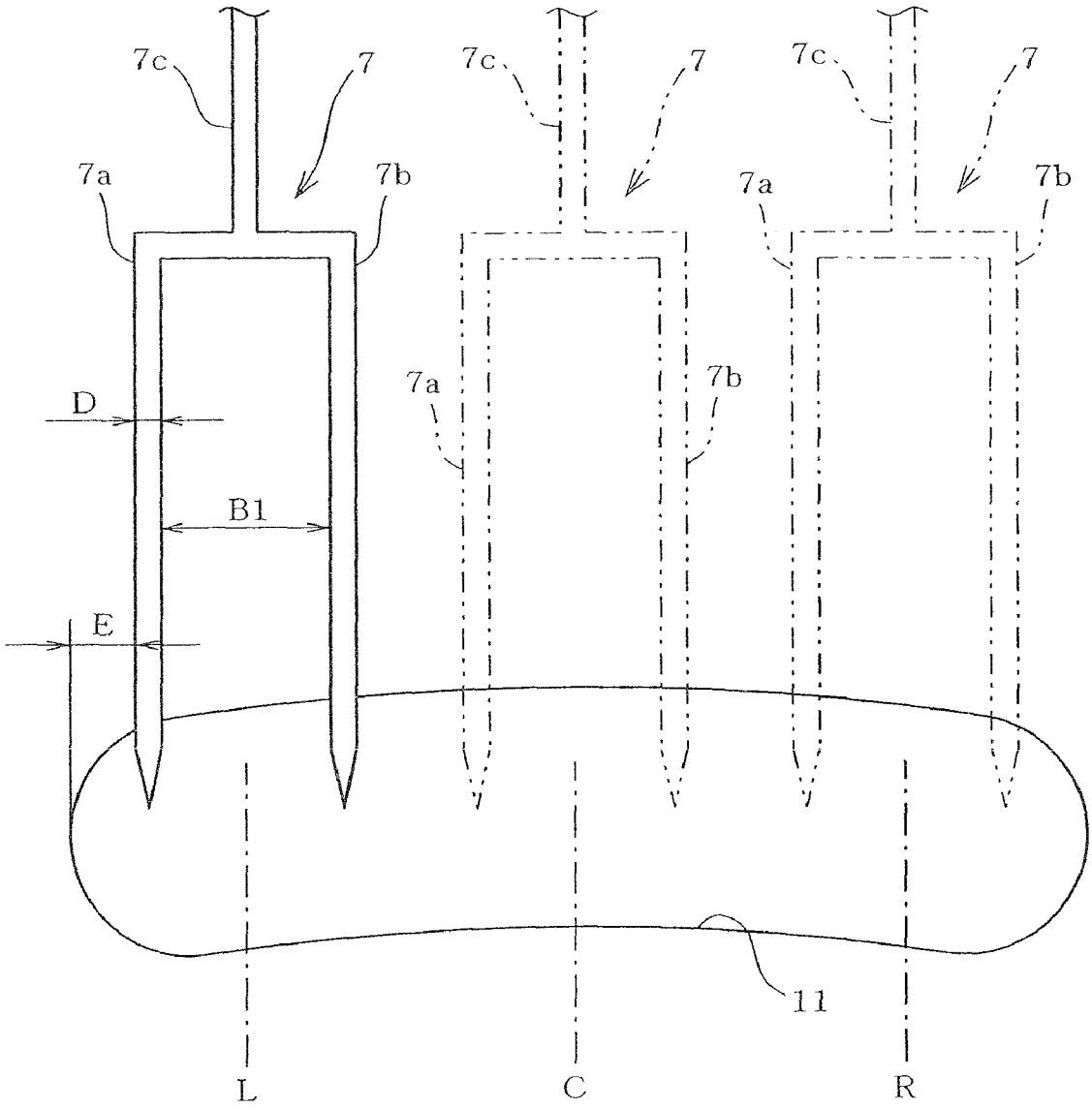
FIG. 12 schematically shows a relative positional relationship between the needle bar and three baselines in a sewing machine in accordance with a second illustrative example of the disclosure.
Figure 13:
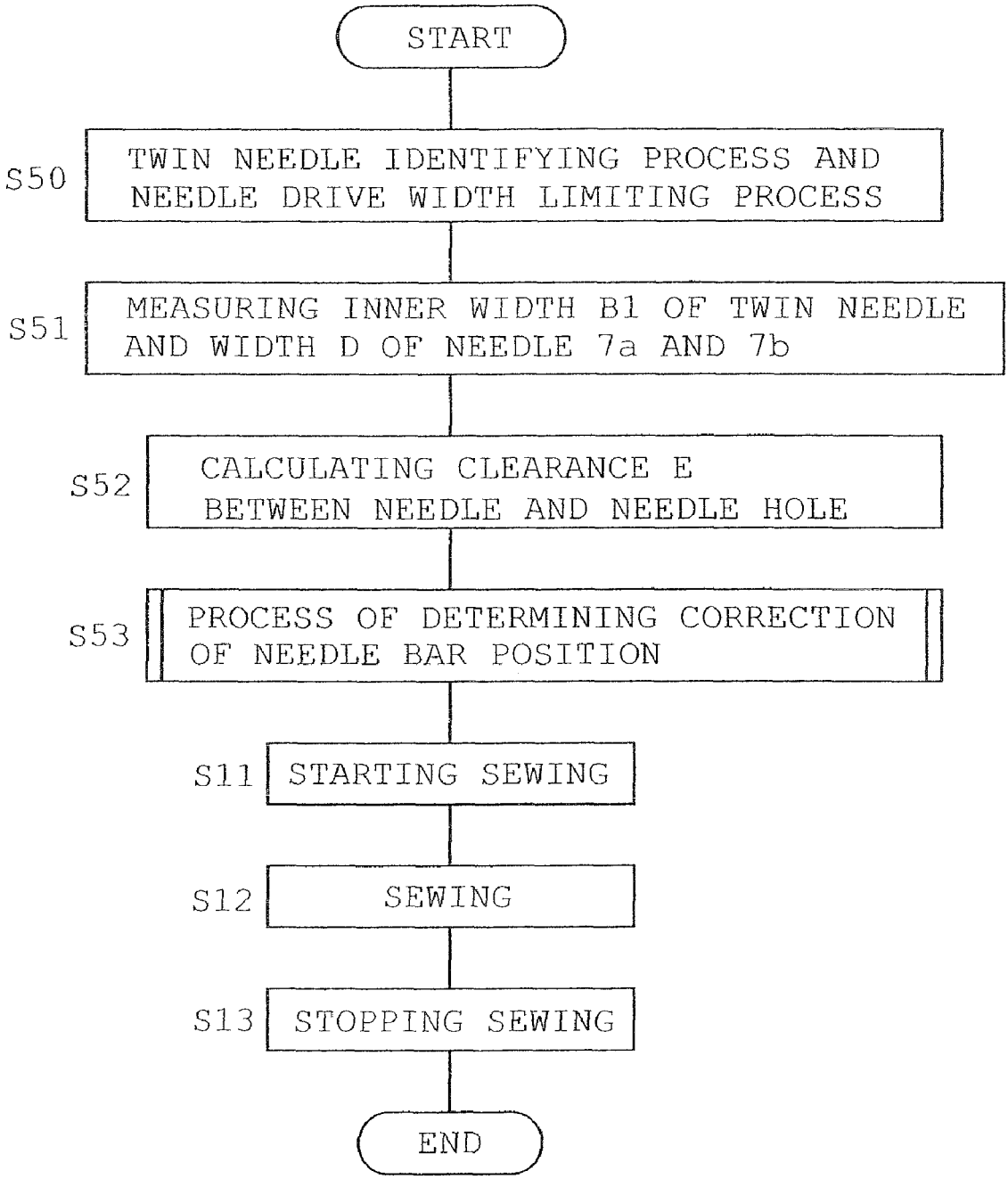
FIG. 13 is a flowchart similar to FIG. 8.
Figure 14A:
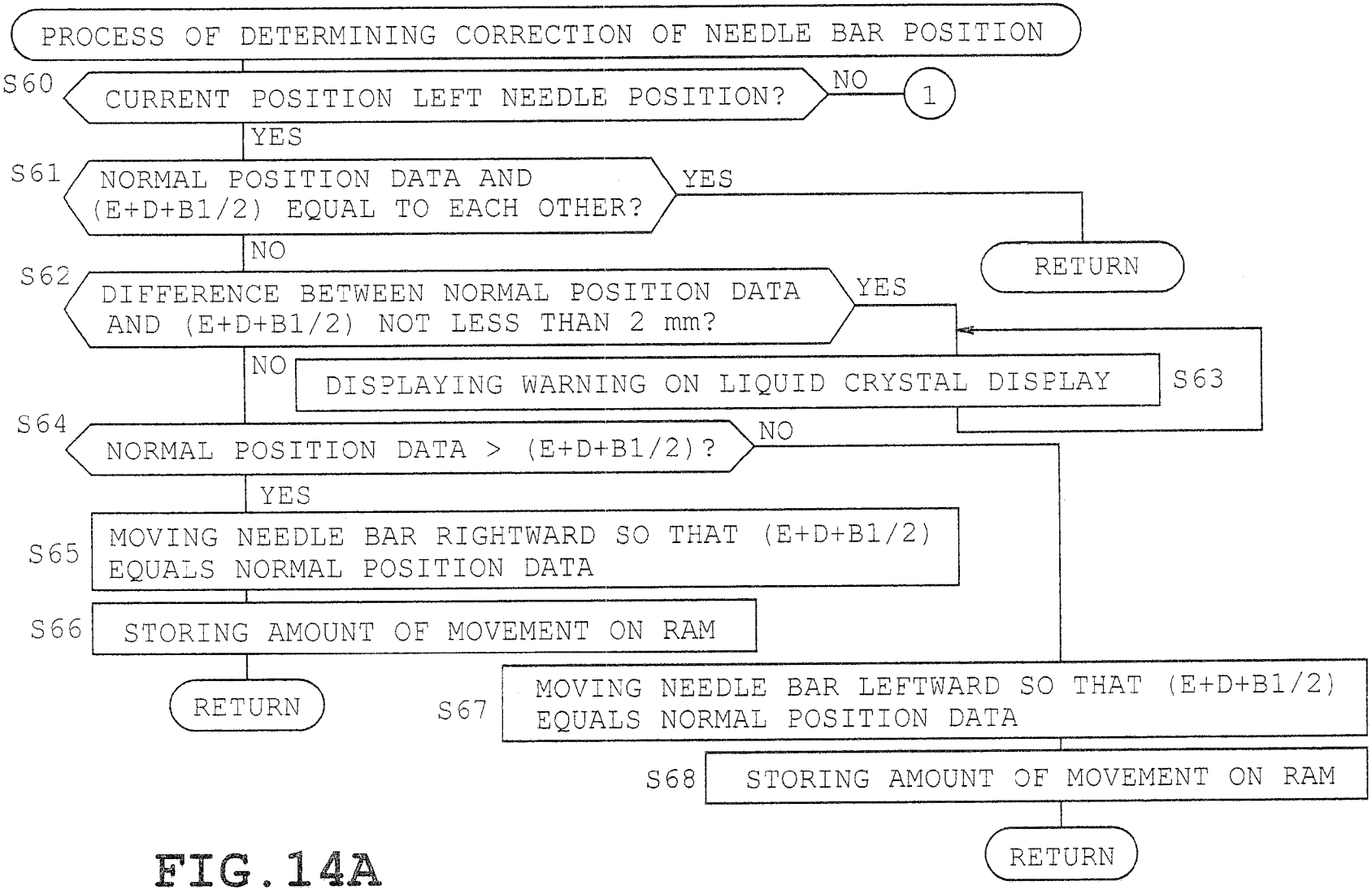
FIG. 14 is a flowchart showing concrete contents of a process of determining correction of needle bar position as shown in FIG. 13.
Figure 14B:
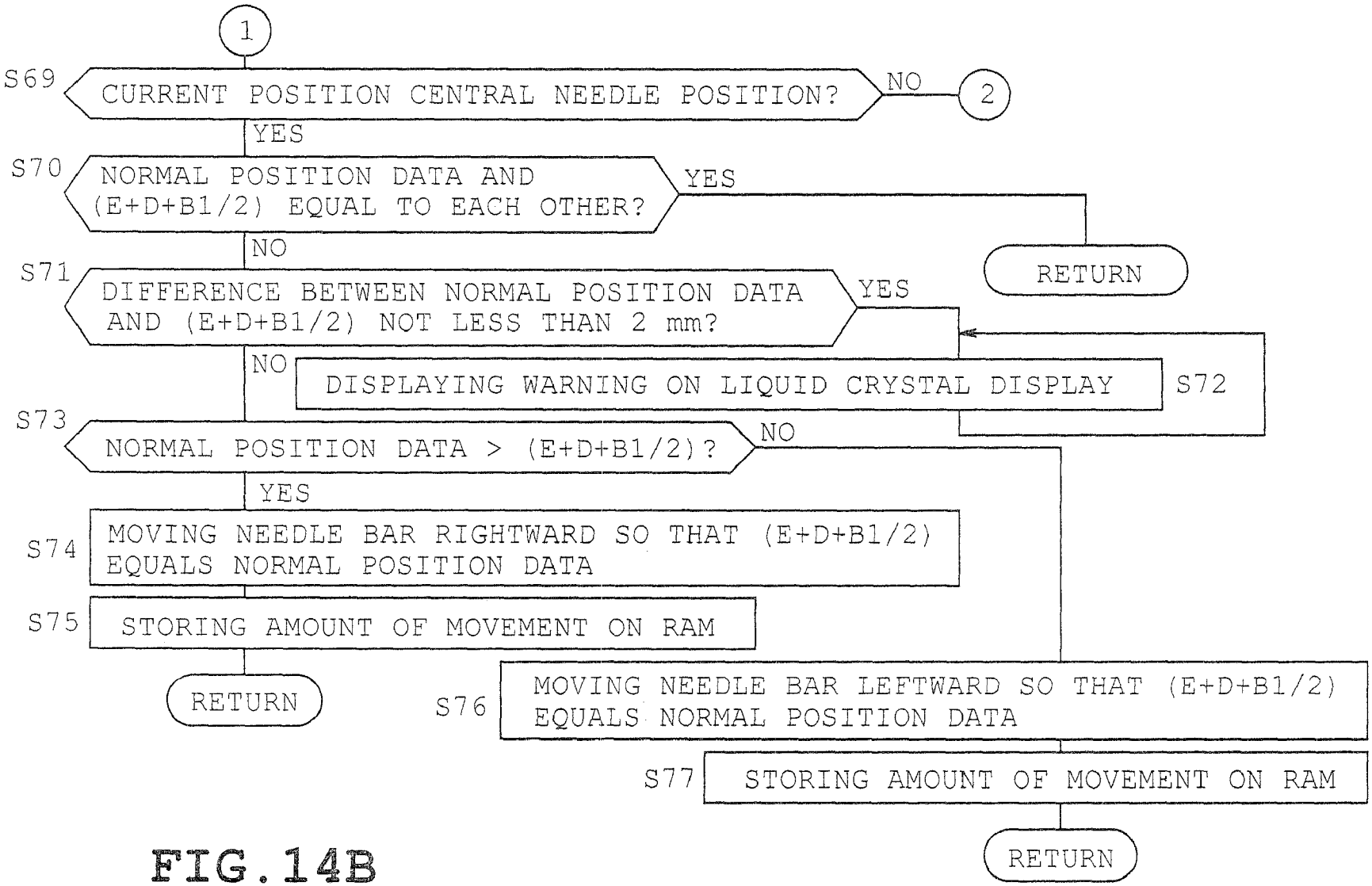
Figure 14C:
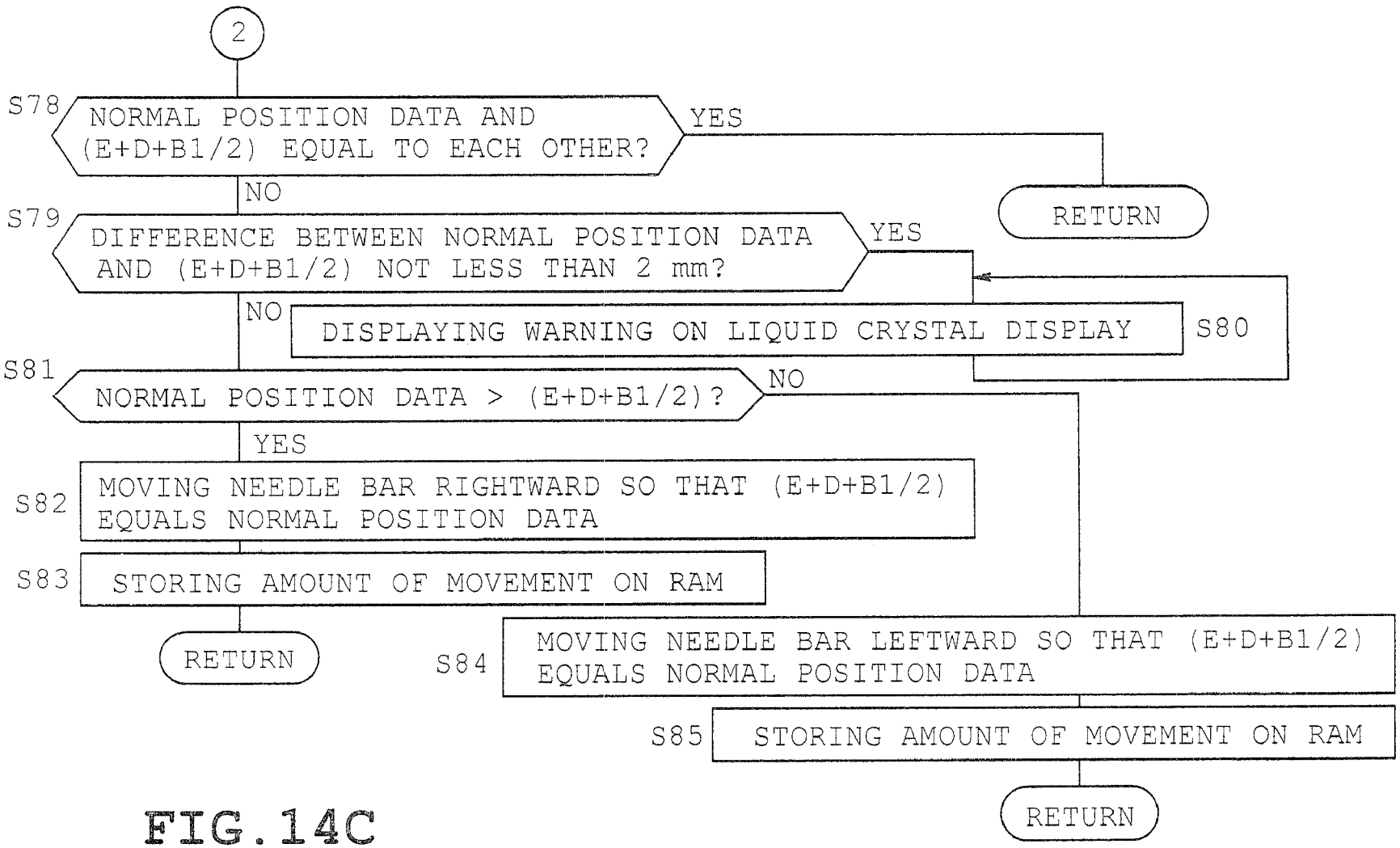
Figure 15:
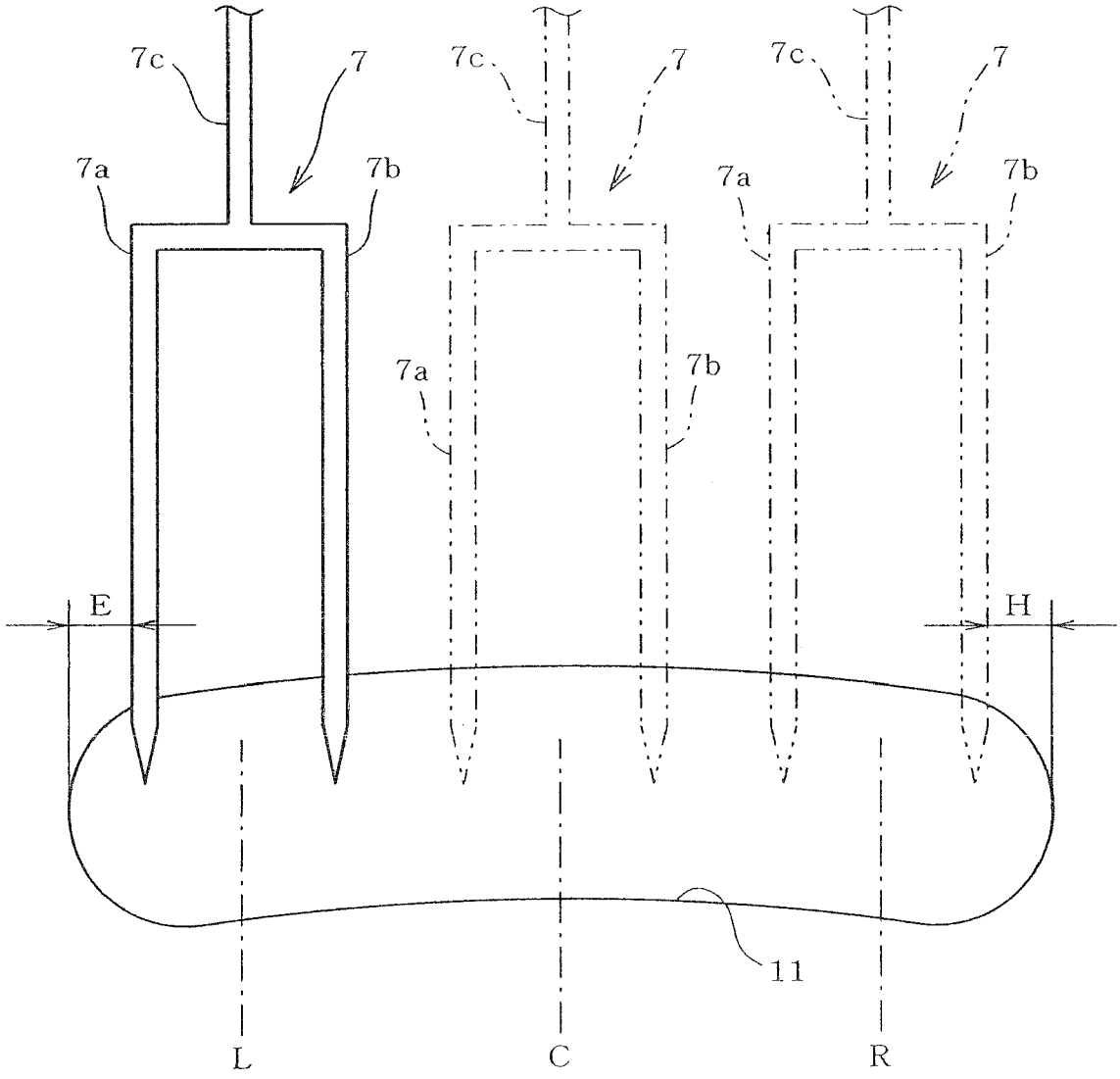
FIG. 15 shows a relationship between the needle bar and three baselines in a sewing machine in accordance with a third illustrative example of the disclosure.
Figure 16:
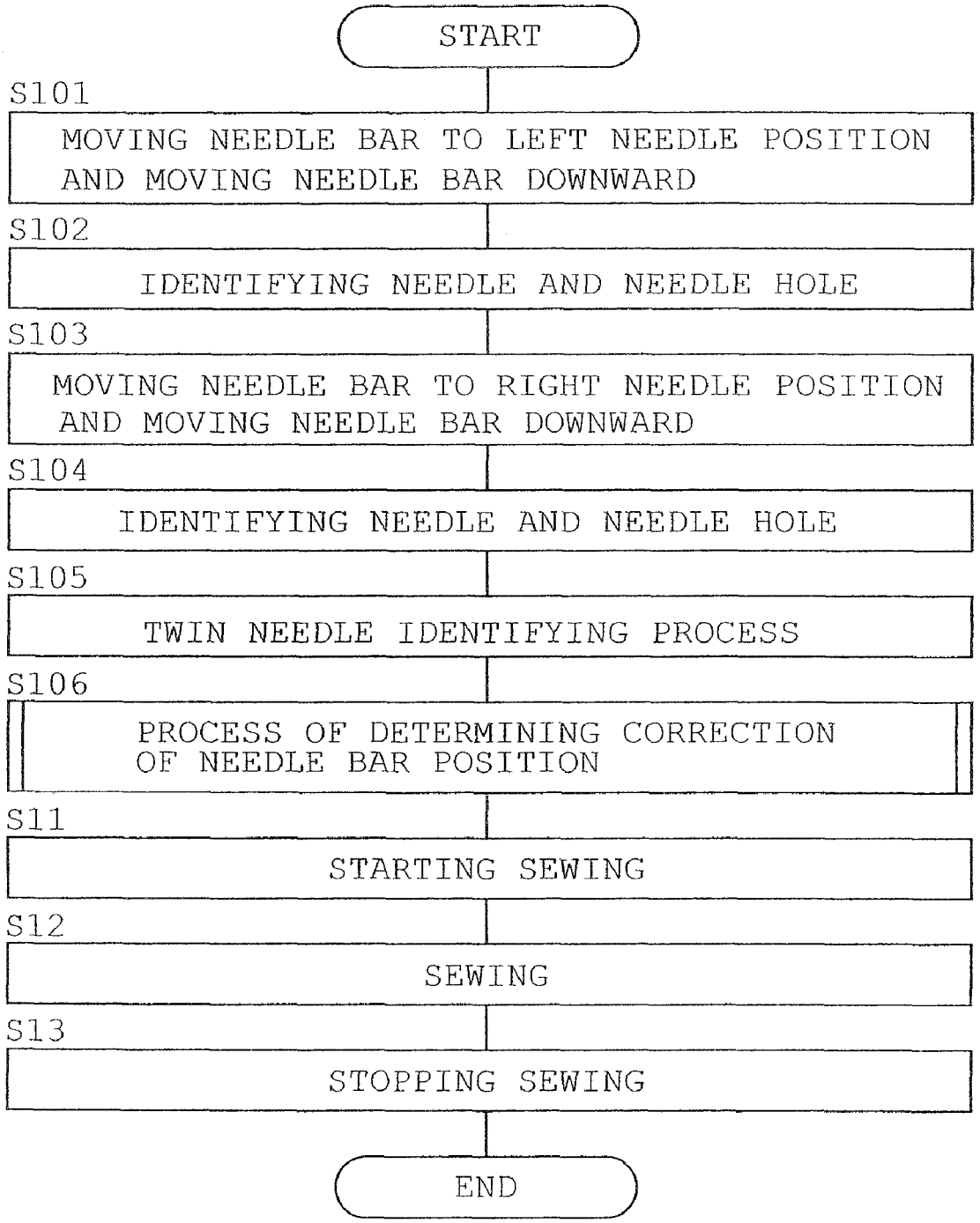
FIG. 16 is a flowchart similar to FIG. 8.
Figure 17:
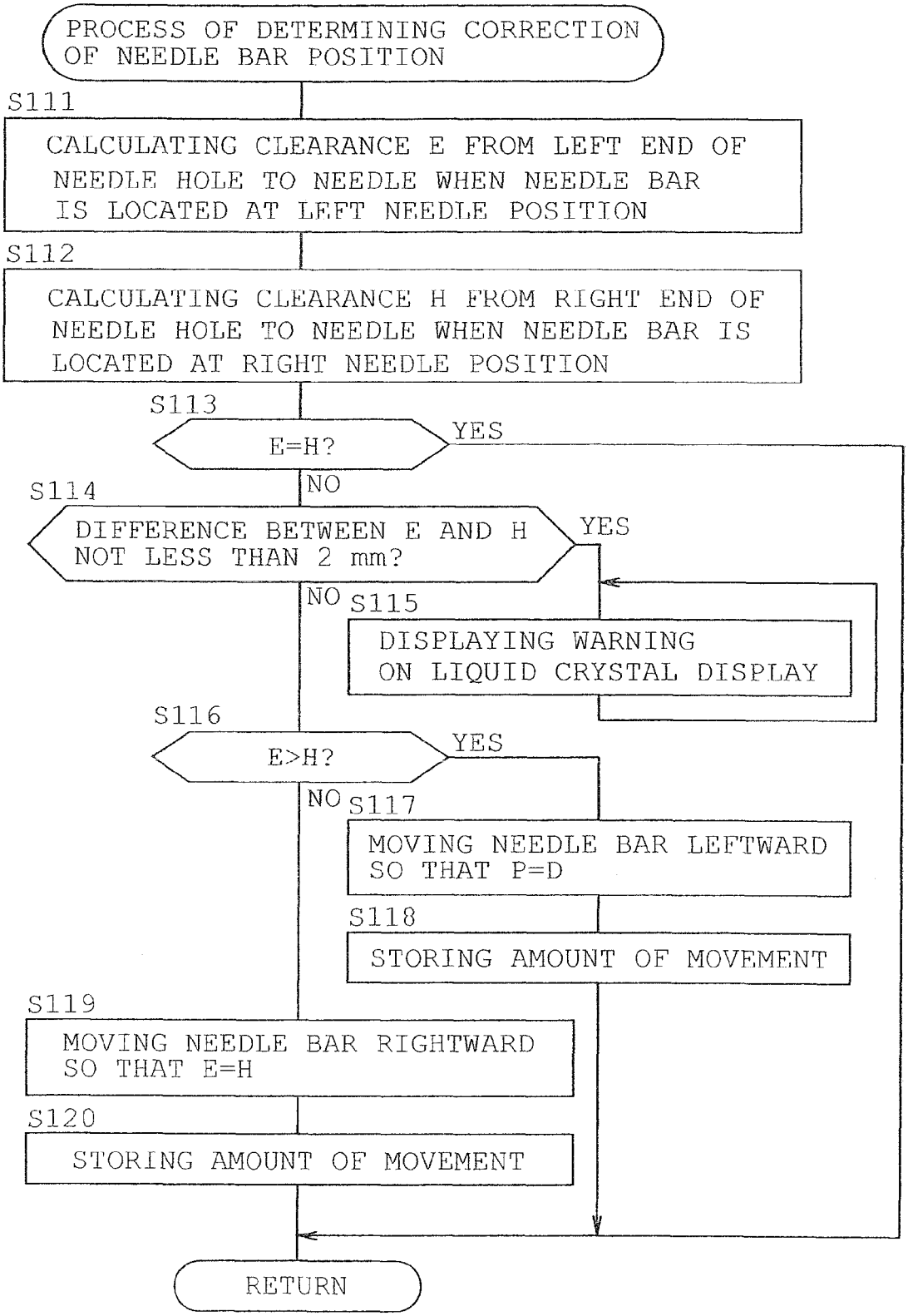
FIG. 17 is a flowchart showing in detail a process of determining correction of needle bar position as shown in FIG. 16.

FIGS. 12 to 14 illustrate a second example, and FIGS. 15 to 17 illustrate a third example. Each of the second and third examples is directed to the case where the twin needle is attached to the needle bar 5, as the first example. Accordingly, the hardware of the sewing machine M in each of the second and third examples is common to that in the first example. Accordingly, identical or similar parts in each of the second and third examples are labeled by the same reference symbols as those in the first example, and new diagrammatic representation and detailed description about these parts will be eliminated. The differences of each of the second and third examples from the third example will be described in the following.

Firstly in the second example as shown in FIGS. 12 to 14, the software configuration or the contents of control executed by the control device 22 differs from that in the first example. More specifically, straight stitches etc. can also be formed at the left needle position L other than at the above-described central needle position C. At the left needle position, the needle bar 5 is rocked leftward by a predetermined amount, that is, the twin needle 7 is passed through the left end inside the needle hole 11. Furthermore, sewing is also possible in the state where the needle bar 5 is rocked rightward by a predetermined amount, that is, at the right needle position R where the twin needle 7 is passed through the right end inside the needle hole 11. In this case, when the sewing machine M is powered on, the needle bar 5 assumes any one of the central needle position C, the right needle position R and the left needle position L according to a stitch pattern selected by the user. In the use of the standard twin needle 7, the distance from the left end of the needle hole 11 to the needle 7*a* is set at 0.5 mm (the normal position) when the needle bar 5 assumes the left needle position L. The distance from the right end of the needle hole 11 to the needle 7*b* is set at 0.5 mm (the normal position) when the needle bar 5 assumes the right needle position R.

When the body of this type of sewing machine M is subjected to a large shock (due to the falling etc.) or a screw is loosened in a mechanism, there is a possibility that the needle bar 5 and the needle position would be displaced from the normal position. A desired working cannot be done upon occurrence of displacement of the needle bar 5. In an extreme case, the needles 7*a* and 7*b* would interfere with the needle plate 10 during the rocking of the needle bar 5 even though the needle drive width A has been limited in the manner as described above.

Therefore, immediately upon power-on of the sewing machine M, the control device 22 determines whether the twin needle 7 has been attached to the needle bar 5, in the second example in the manner as described in the first example. The control device 22 also sets an upper limit of allowable rocking range of the needle bar 5 in the case where the twin needle 7 is attached to the needle bar 5. Furthermore, the control device 22 determines whether the needle bar 5 assumes the aforesaid normal position, based on the contour images extracted from the images of the needle hole 11 and the twin needle 7 taken by the image sensor 23 and an inner width B1 (see FIG. 12) between the needles 7*a* and 7*b*. With this, when the needle bar 5 is displaced from the normal position, the control device 22 corrects the position of the needle bar 5 so that the needle bar 5 assumes the normal position. Accordingly, the control device 22 functions as a determining process section and a correction control process section. Subsequently, the control device 22 executes sewing according to previously set stitch patterns.

More specifically, when the needle bar 5 assumes the position corresponding to the right or left needle position, the control device 22 calculates a horizontal distance E (see FIG. 12) between the needle 7*a* or 7*b* of the twin needle 7 and the right or left end of the needle hole 11, and the width D (see FIG. 12) of each of the needles 7*a* and 7*b*, based on the contour images extracted by the image processing circuit 24. The control device 22 then determines the needle bar 5 assumes the normal position, based on the calculated distance E and width D of each of the needles 7*a* and 7*b*.

When the needle bar 5 is displaced from the normal position by a predetermined value or above and the control device 22 determines that the needle bar 5 is in an abnormal condition, the control device 22 controls the liquid crystal display 17 and the buzzer 34 each serving as the warning device so that warning is given to the user. The control device 22 stores on the RAM 28 the position data of the needle bar 5 corrected based on the above-described determination and an amount of movement (the number of pulses) of the needle bar 5 in the correction. The RAM 28 thus serves as storage device.

The contents of control executed by the control device 22 in the second example will now be described in detail in the following. Referring to the flowchart of FIG. 13, when the sewing machine M is powered on such that the control device 22 starts, the control device 22 advances to step S50 to execute the twin needle recognizing process and the needle drive width limiting process. Since step S50 in the second example corresponds to the processes from steps S1 to S6 (see FIGS. 8 to 11) in the first example, the description of step S50 will be eliminated. However, although the processes at steps S1 to S6 are executed in the first example while the needle bar 5 assumes the X coordinate zero point (the origin), the process at step S50 in the second example is executed when the needle bar 5 also assumes a position corresponding to the right or left needle position R or L as well as the X coordinate zero point.

Subsequently, the control device 51 measures the inner width B1 of the twin needle 7 and the width D of each of the needles 7*a* and 7*b* (see FIG. 12). The control device 22 then advances to step S52 to calculate the distance E (see FIG. 12) between the left end of the needle hole 11 and the needle 7*a*, based on the extracted contour images of twin needle 7 and the needle hole 11.

The control device 22 then advances to step S53 to execute a needle bar position correction determining process with respect to the needle bar 5 as shown in FIG. 14. More specifically, the control device 22 determines whether the needle bar 5 assumes the left needle position L. When the needle bar 5 assumes the left needle position L (S60: YES), the control device 22 advances to step S61 determines whether the aforesaid normal position data of the left needle position L is equal to the value of (E+D+B1/2) calculated from the inner width B1 of the twin needle 7, the left distance E and the width D measured at steps S51 and S52. When the normal position data of the left needle position L is equal to the value of (E+D+B1/2) (S61: YES), the control device 22 determines that the position of the needle bar 5 is normal. In this case, the control device 22 returns to the main routine of FIG. 13 to execute the processes at steps S1 to S13. The value of (E+D+B1/2) denotes the distance from the left end of the needle hole 11 to the center of the needle bar 5.

When the value of (E+D+B1/2) differs from the normal position data of the left needle position (S61: NO), the control device 22 advances to step S62 to determine whether the difference between the value of (E+D+B1/2) and the normal position data of the left needle position is at or above 2 mm, for example. When the difference is equal to or larger than 2 mm (S62: YES), the control device 22 determines that the difference exceeds a needle bar position correctable range and accordingly that the needle bar 5 is in an abnormal condition. In this case, the control device 22 advances to step S63 to warn the user against the abnormal condition. The warning is carried out by the liquid crystal display 17 or the buzzer 34, each of which prompts the user to repair the sewing machine M.

When the difference between the value of (E+D+B1/2) and the normal position data of the left needle position is less than 2 mm (S62: NO), the control device 22 advances to step S64 to further determine whether the normal position data of the left needle position L is larger than the value of (E+D+B1/2). When the normal position data is larger than the value of (E+D+B1/2) (S64: YES), the control device 22 advances to step S65 where the stepping motor 13 is driven via the drive circuit 32 or the positive pulses are applied to the stepping motor 13 until the value of (E+D+B1/2) equals the normal data, whereby the needle bar 5 is moved rightward.

Data of an amount of movement (the number of correcting pulses) of the needle bar 5 by the drive of the stepping motor 13 is stored on the RAM 28 at next step S66. Subsequently, the control device 22 returns to the main routine of FIG. 13 to execute the processes at steps S11 to S13. Since the aforesaid data of movement amount is stored on the RAM 28, the needle bar 5 is retained at the normal position with respect to the left needle position L during the sewing operation. On the other hand, when determining at step S64 that the normal position data is smaller than the value of (E+D+B1/2) (S64: NO), the control device 22 advances to step S67 where the stepping motor 13 is driven via the drive circuit 32 or the negative pulses are applied to the stepping motor 13 until the value of (E+D+B1/2) equals the normal data, whereby the needle bar 5 is moved leftward.

Data of an amount of movement of the needle bar 5 by the drive of the stepping motor 13 is stored on the RAM 28 at step S68. The control device 22 then returns to the main routine of FIG. 13 to execute the processes at steps S11 to S13. Since the aforesaid data of movement amount is stored on the RAM 28, the needle bar 5 is retained at the normal position during the sewing operation.

On the other hand, when the needle bar 5 is not located at the left needle position L at step S60 (S60: NO), the control device 22 advances to step S69 to determine whether the needle bar 5 assumes the central needle position C. When the needle bar 5 assumes the central needle position C (S69: YES), the control device 22 executes processes at steps S70 to S77 to carry out the same process as when the needle bar 5 assumes the left needle position L. Since the processes at steps S70 to S77 are the same as those at steps S61 to S68 with only the difference of the normal needle position data, the detailed description will be eliminated.

Furthermore, when the needle bar 5 does not assume the central needle position, that is, when the needle bar 5 assumes the right needle position R, the control device 22 executes the same processes at steps S78 to S85 as those in the case where the needle bar 5 assumes the left needle position L. The processes at steps S78 to S85 are the same as those at steps S61 to S68 with only the difference of the normal needle position data.

According to the second example as described above, the actual positional relation between the needle hole 11 and the twin needle 7 can directly be detected based on the contour images of the twin needle 7 and the needle hole 11 extracted from the images of the twin needle 7 and the needle hole 11 taken by the image sensor 23. As a result, whether the needle bar 5 assumes the normal position can accurately be determined and the correction can be carried out even when the needle bar 5 assumes any one of the right, central and left needle positions R, C and L. This can prevent the drawback such as interference of the needle bar 10 with the twin needle 7 due to the displacement of the needle bar 5 from the normal needle position.

Furthermore, the displacement of the needle bar 5 from the normal needle position can be determined and corrected by using the image sensor 23 and the image processing circuit 24 provided for control of the needle drive width A. This denecessitates addition of mechanical construction, whereupon the determination and correction of the displacement of the needle bar 5 can be carried out by the simple construction.

The space E between the needle 7*a* and the left end of the needle hole 11, the width B1 and the width D of the needle 7*a* are calculated based on the contour images of the twin needle 7 and the needle hole 11 obtained by the image sensor 23 and the image processing circuit 24. Since the needle drive width of the needle bar accurately corresponding to the twin needle 7 can be determined, various types of twin needles 7 with respective different widths can be used. Furthermore, when the displacement of the needle bar 5 from the normal needle position is at or above 2 mm, the user can be warned about the abnormal condition by the warning device of the liquid crystal display 17 and the buzzer 34. Consequently, the user can take proper measures against the abnormal condition. Additionally, the sewing operation can be carried out while the needle bar 5 is normally corrected so as to assume the normal position since data of position of the needle bar 5 after correction or data of amount of movement of the needle bar 5 in the correction is stored.

The third example will now be described with reference to FIGS. 15 to 17. In the third example, the software configuration (the control contents of the control device 22) of the sewing machine M differs from those in the first and third examples although the hardware of the sewing machine M is the same as in the first and second examples. In the third example, the left distance E is defined between the needle 7*a* and the left end of the needle hole 11 in the case where the needle bar 5 assumes the position corresponding to the left needle position. The right distance H is defined between the needle 7*b* and the right end of the needle hole 11 in the case where the needle bar 5 assumes the position corresponding to the right needle position. The left and right distances E and H are calculated based on the contour images of the twin needle 7 and the needle hole 11 extracted by the image processing circuit 24 as shown in FIG. 15. Based on the calculated distances E and H, the control device 22 determines whether the needle bar 5 assumes the normal position. Correction or the like is carried out when the needle bar 5 does not assume the normal needle position.

Referring to the flowchart of FIG. 16, the entire processing procedure (main routine) executed by the control device 22 is shown. Firstly, when the needle bar rocking mechanism 14 is driven via the drive circuit 32 to move the needle bar 5 to the left needle position L, the control device 22 controls via the drive circuit 31 the sewing machine motor 12 to lower the needle bar 5, at step S101. The twin needle 7 and the needle hole 11 are imaged by the image sensor 23 at step S102. The obtained image data is converted to an image substantially as a front view and thereafter, computation processing is carried out based on the data obtained by the contour (edge) extracting process, whereby contour images of the twin needle 7 located at the left needle position L and the needle hole 11 are obtained.

The control device 22 advances to step S103 to drive via the drive circuit 32 the needle bar rocking mechanism 14 so that the needle bar 5 is moved to the right needle position R. The control device 32 also drives via the drive circuit 31 the motor 12 so that the needle bar 5 is lowered. At step S103, the twin needle 7 and the needle hole 11 are imaged by the image sensor 23. The obtained image data is converted to an image substantially as a front view and thereafter, computation processing is carried out based on the data obtained by the contour (edge) extracting process, whereby contour images of the twin needle 7 located at the right needle position R and the needle hole 11 are obtained. At step S105, the twin needle recognizing process and the needle drive width limiting process are carried out in the same manner as at step S50 in FIG. 13 in the above-described second example.

The needle bar position correction determining process is carried out at step S105. Referring to the flowchart of FIG. 17, the needle bar position correction determining process is shown in detail. At step S111, the left distance E (see FIG. 15) from the left end of the needle hole 11 to the needle 7*a* is calculated based on the contour images of the twin needle 7 assuming the left needle position L and the needle hole 11 obtained at step S102. At step S112, the right distance H (see FIG. 15) from the right end of the needle hole 11 to the needle 7*b* is calculated based on the contour images of the twin needle 7 assuming the right needle position R based on the contour images of the twin needle 7 assuming the right needle position R and the needle hole 11 both obtained at step S104. Subsequently, needle bar position correction determining process and the needle drive width limiting process are carried out at step S105 in the same manner as at step S50 in FIG. 13 in the above-described second example.

The needle bar position correcting process is then carried out at step S106. Referring to the flowchart of FIG. 17, the needle bar position correction determining process is shown in detail. At step S111, the left distance E (see FIG. 15) from the left end of the needle hole 11 to the needle 7*a* is calculated based on the contour images of the twin needle 7 assuming the left needle position L and the needle hole 11 obtained at step S102. At step S112, a right distance H (see FIG. 15) from the right end of the needle hole 11 to the needle 7*b* is calculated based on the contour images of the twin needle 7 located at the right needle position R and the needle hole 11 obtained at step S104.

Subsequently, the values of the right and left distances H and E are compared, and processing according to the result of comparison is carried out. At step S113, the control device 22 determined whether the right and left distances H and E are equal to each other. When determining that the right and left distances H and E are equal to each other (S113: YES), the control device 22 determines that the needle bar 5 assumes the normal position, returning to the main routine of FIG. 16 to execute processes at steps S11 to S13 as described above. On the other hand, when determining that the right and left distances H and E differ from each other (S113: NO), the control device 22 advances to step S114.

At step S114, the control device 22 determines whether the difference between right and left distances H and E is equal to or above 2 mm. When determining that the difference is equal to or above 2 mm (S114: YES), the control device 22 further determines that the sewing machine M exceeds an executable range of the needle bar position correction determining process and is accordingly in an abnormal condition. In this case, the control device 22 advances to step S115 to control the liquid crystal display 17 and the buzzer 34 so that the user is warned against the abnormal condition by the displaying of the liquid crystal display 17 and activation of the buzzer 34. This prompts the user to repair the sewing machine M. When determining that the difference is less than 2 mm (S114: NO), the control device 22 advances to step S116.

The control device 22 determines at step S116 whether the left clearance E is larger than the right clearance H. When the left clearance E is larger than the right clearance H (S116: YES), the needle bar 5 is located on the right side of the normal position. Accordingly, the control device 22 drives via the drive circuit 32 or applies negative pulses to the stepping motor 13 (see FIG. 3) until the left clearance E becomes equal to the right clearance H. As a result, the needle bar 5 is moved leftward (step S117). At next step S118, data of amount of movement of the needle bar 5 moved by the drive of the stepping motor 13 is stored on RAM 28. Subsequently, the control device 22 returns to the main routine of FIG. 16 to execute processes at steps S11 to S13.

When the left clearance E is smaller than the right clearance H (S116: NO), the needle bar 5 is located on the left side of the normal position. Accordingly, the control device 22 drives via the drive circuit 32 or applies positive-direction pulses to the stepping motor 13 (see FIG. 3) until the left space E become equal to the right clearance H. As a result, the needle bar 5 is moved rightward (step S119). At step S120, data of amount of movement of the needle bar 5 moved by the drive of the stepping motor 13 is stored on RAM 28. Subsequently, the control device 22 returns to the main routine of FIG. 16 to execute processes at steps S11 to S13.

In the third example as described above, the control device 22 calculates the left clearance E between the needle bar 5 located at the left needle position L and the left end of the needle hole 11, and the right clearance H between the needle bar 5 located at the right needle position R and the right end of the needle hole 11. The control device 22 reliably determines whether the needle bar 5 is located at the normal position, based on correspondence and magnitude relation between the right and left clearance H and E. Consequently, the needle bar 5 can reliably be located at the normal positions (the central needle position C, zero point on X coordinate (origin)). Furthermore, when the needle drive width in the sewing of zigzag pattern is excessively larger, the needle drive width can automatically be reduced so that the twin needle 7 is prevented from interfering with the needle plate 10. This can reliably prevent drawback such as the interference of the needles 7*a* and 7*b* constituting the twin needle 7 and the needle plate 10 during sewing.

The twin needle 7 is exemplified as the plural needles in the first to third examples. However, a triple needle having three or more needles spaced in the right-left direction may be provided on a lower part of the shank 7*c* to be attached to the needle bar 5, for example. Furthermore, in the second and third examples are used the width of the needles 7*a* and 7*b* (0.9 mm), the threshold (2 mm) used in the determination (S62, S71, S79 and S114) of abnormal location of the needle bar 5 in the process of determining needle bar position correction (S53 and S106). These values are merely examples but various types of thresholds may be set depending upon types of sewing machines, for example.

Fourth and fifth examples will be described with reference to FIGS. 18 to 22. The hardware of the sewing machine M in each of the fourth and fifth examples in common to that in the first example except for the needle which will be described later. More specifically, each of the fourth and fifth examples is common to the first example in the entire appearance of the sewing machine M as shown in FIG. 1, the construction or arrangement of the presser foot 6 and the image sensor 23 both as shown in FIG. 2, the construction of the needle bar base 45, the needle bar 5 and the needle bar rocking mechanism 14 as shown in FIG. 3, the construction of the needle plate 10 (needle hole 11) as shown in FIG. 5 and the electrical arrangement of the control device 22 as shown in FIG. 6.

Accordingly, identical or similar parts in each of the fourth and fifth examples are labeled by the same reference symbols as those in the first example, and new diagrammatic representation and detailed description about these parts will be eliminated. The difference of each of the fourth and fifth examples from the first example will be described in the following.

Figure 18:
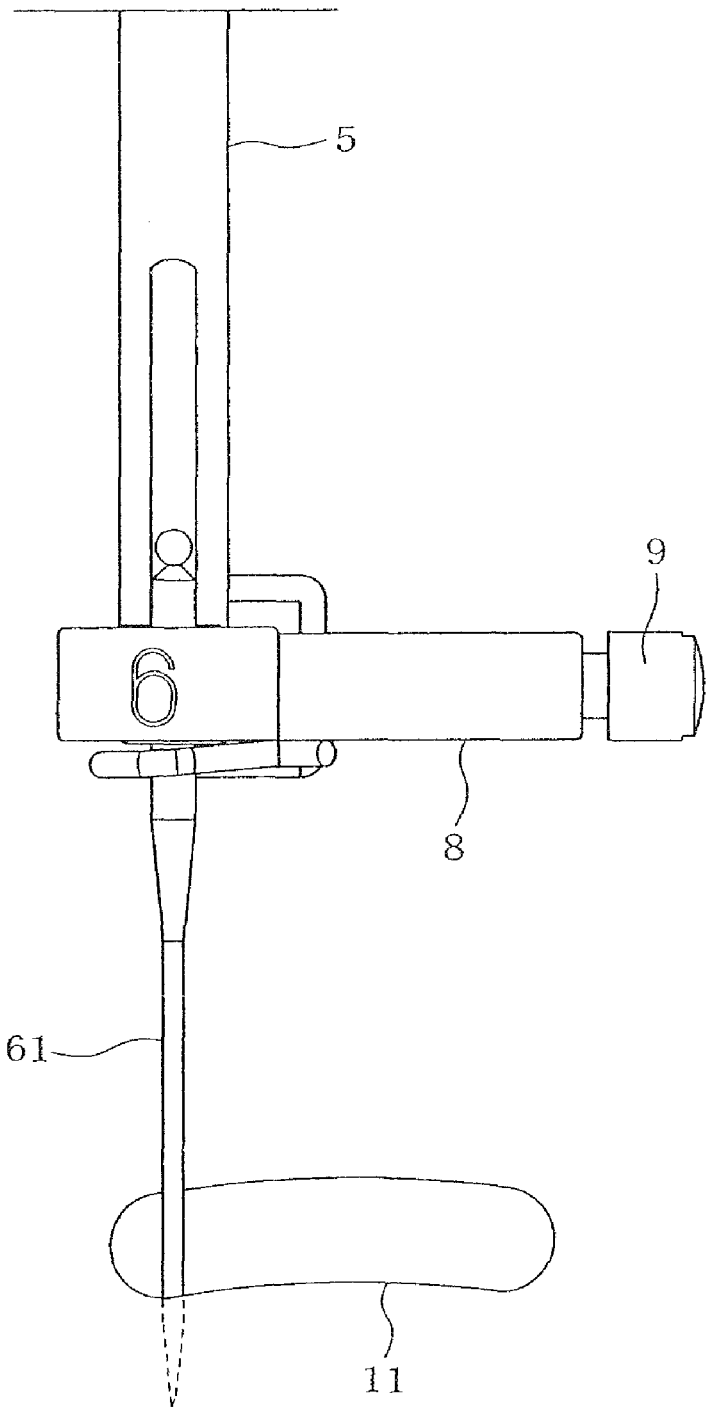
FIG. 18 is an enlarged front view of the needle bar to which the needle is attached, showing the relationship between the needle bar and the needle hole in a fourth illustrative example of the disclosure.

An ordinary needle 61 is attached to the lower end of the needle bar 5 in the fourth example as shown in FIG. 18. The needle 61 will be referred to as "single needle 61" for the sake of convenience. Single needles 61 having different widths are prepared and are replaceable. The single needle having the width of 0.9 mm is attached to the needle bar 5 in the fourth example.

The sewing machine M can perform zigzag pattern sewing by rocking the needle bar 5 in the right-left direction by the needle bar rocking mechanism 14. Furthermore, as shown in FIG. 9, the sewing machine M can perform straight pattern sewing with the needle bar 5 located at a left position, that is, the left needle position L where the single needle 61 is passed through the left end of the needle hole 11 as well as the central needle position C. The sewing machine M can also perform straight pattern sewing with the needle plate 5 located at a right position, that is, the right needle position R where the single needle 61 is passed through the right end f the needle hole 11. In this case, the needle bar 5 is moved to be located at any one of the central needle position C, the left needle position L and the right needle position R according to a stitch pattern selected by the user. Furthermore, since the needle bar 5 is stopped at the needle-up position located higher than the needle plate 10 when the sewing operation is stopped, the single needle 61 and the needle hole 11 are imaged by the image sensor 23 when the needle bar 5 is moved by the sewing machine motor 12 thereby to be located at the needle-down position as will be described later.

The control device 22 automatically detects (determines) whether a needle position of the single needle 61 with respect t the needle hole 11 is a normal position. When the sewing machine M is in an abnormal condition (displaced) as the result of detection, the control device 22 corrects the abnormal condition. More specifically, before start of a sewing operation by the sewing machine M, the control device 22 controls the image sensor 23 and the image processing circuit 24 so that the single needle 61 and the needle hole 11 are imaged by the image sensor 23 and so that the contour images of the single needle 61 and the needle hole 11 are extracted by the image processing circuit 24. Based on the contour images of the single needle 61 and the needle hole 11, the control device 22 determines whether the needle position of the single needle 61 corresponds to a predetermined normal position. When the single needle 61 is displaced from the normal position, the control device 22 drives the stepping motor 13 s that the single needle 61 is located at the normal position.

Figure 19:
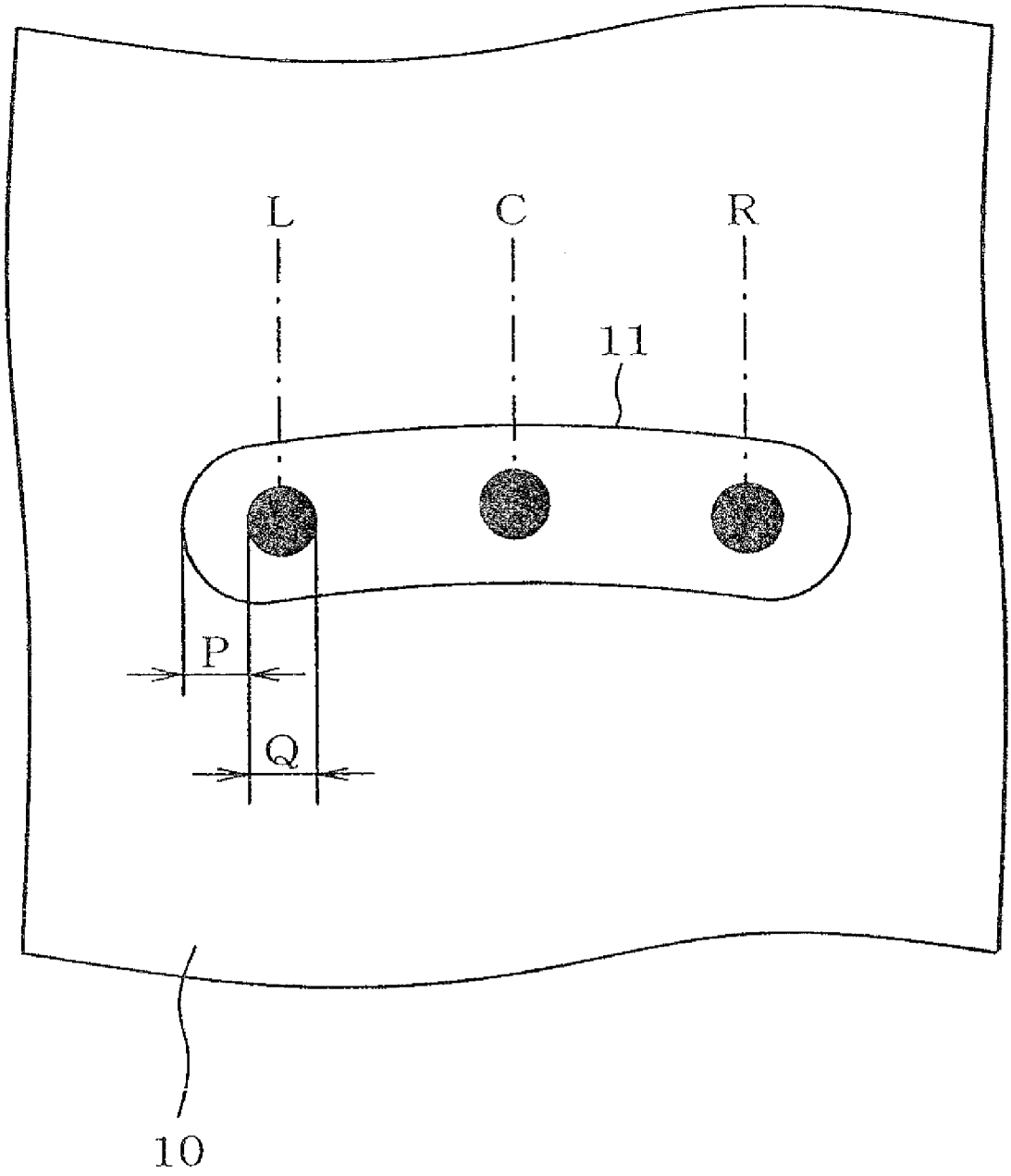
FIG. 19 shows the relationship between the needle hole and needle locations (three baselines)

More specifically, the control device 22 obtains the width Q of the single needle 61 and a left space P between an end of the needle hole 11, for example, a left end as shown in FIG. 19. Based on the obtained width Q of the single needle 61 and left clearance P, the control device 22 compares the actual needle position of the single needle 61 with the data of normal position to determine whether the needle position of the single needle 61 corresponds to the needle position. In this case, when the actual needle position is displaced and an amount of displacement is smaller than a predetermined threshold, the actual needle position of the single needle 61 is corrected. On the other hand, when the amount of displacement exceeds the threshold, the control device 22 determines that a defect is at such a level that repair is necessitated, displaying on a screen of the liquid crystal display 17 a message that the needle position of the single needle 61 is defective and activating the buzzer 34 for a warning purpose. Accordingly, the control device 22 functions as a determination section and a correction control device. Furthermore, the control device 22 constitutes a warning device together with the liquid crystal display 17 and the buzzer 34.

The working of the sewing machine M thus constructed will be described as follows with reference to FIGS. 20 to 22. A process of determining correction of the needle position of the single needle 61 may be executed every immediately after the sewing machine M is powered on, when a driving time of the sewing machine motor 12 (accumulation time) exceeds a predetermined time or when the user operates a key.

Figure 20:
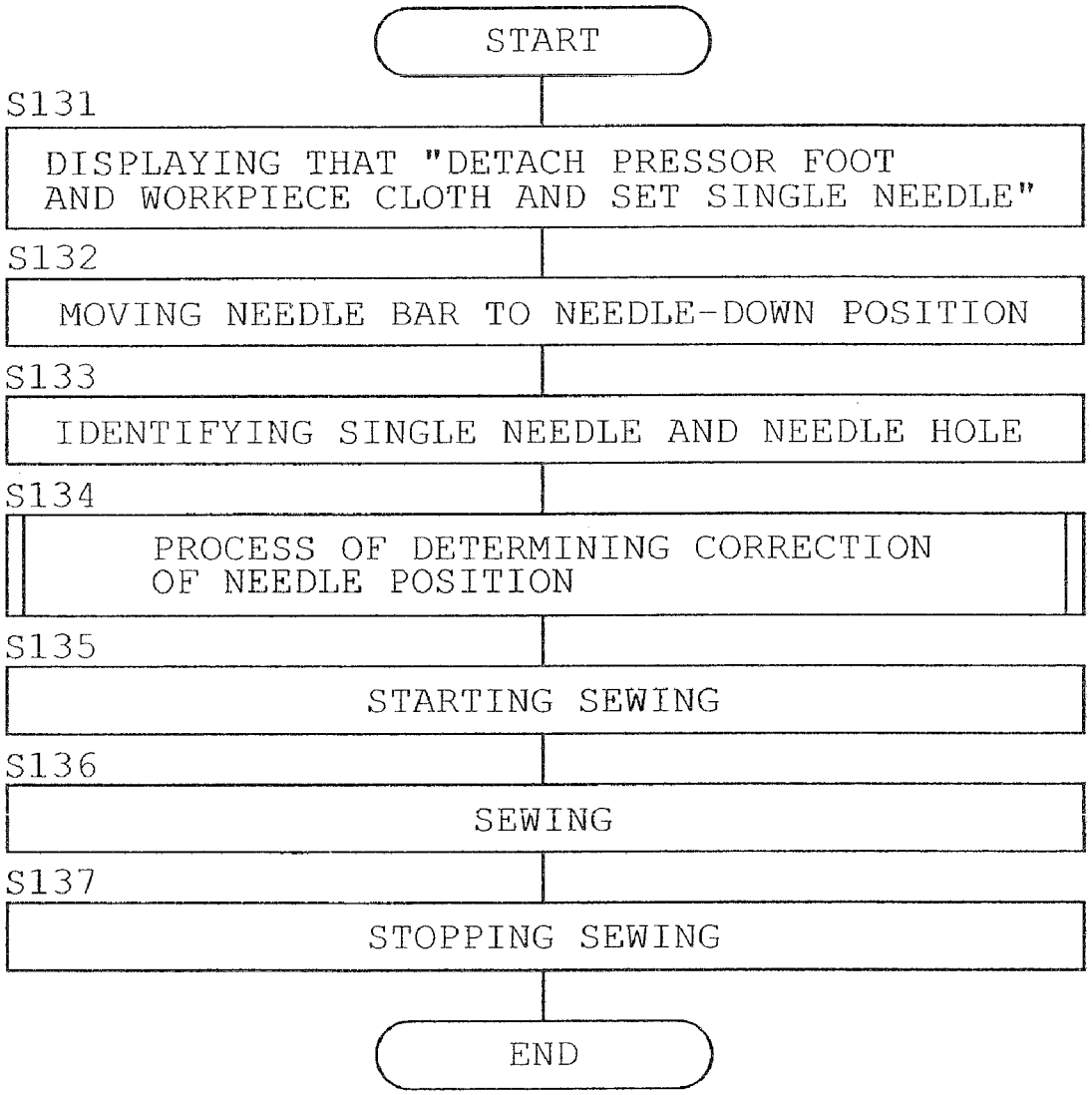
FIG. 20 is a flowchart similar to FIG. 8, showing a normal use of the sewing machine.

Referring to FIG. 20, the control contents (main routine) executed by the control device 22 is shown. The control device 22 starts upon power-on of the sewing machine M. When the sewing machine M has been powered on, the needle bar 5 (the single needle 61) is stopped at a position (needle-up position) corresponding to any one of the left needle position L, the central needle position C and the right needle position R according to a currently selected stitch pattern. Firstly at step S131, the control device 22 activates via the drive circuit 20 the liquid crystal display 17 so that a message is displayed, in order that the user is prompted to detach the presser foot 6, to remove the workpiece cloth from the upper surface of the needle plate 10 and to attach the single needle 61.

The control device 22 then drives via the drive circuit 31 the sewing machine motor 12 thereby to move the needle bar 5 downward so that the single needle 61 is moved to the needle-down position, at step S132. At step S133, the single needle 61 and the needle hole 11 are imaged by the image sensor 23 from obliquely above. The obtained image data is converted to an image substantially as a front view and thereafter, the image is binarized so that contours (edges) are extracted. The width of the needle 7 and the left space P between the left end of the needle hole 11 and the needle 7 are obtained based on the needle hole 11.

Figure 21A:
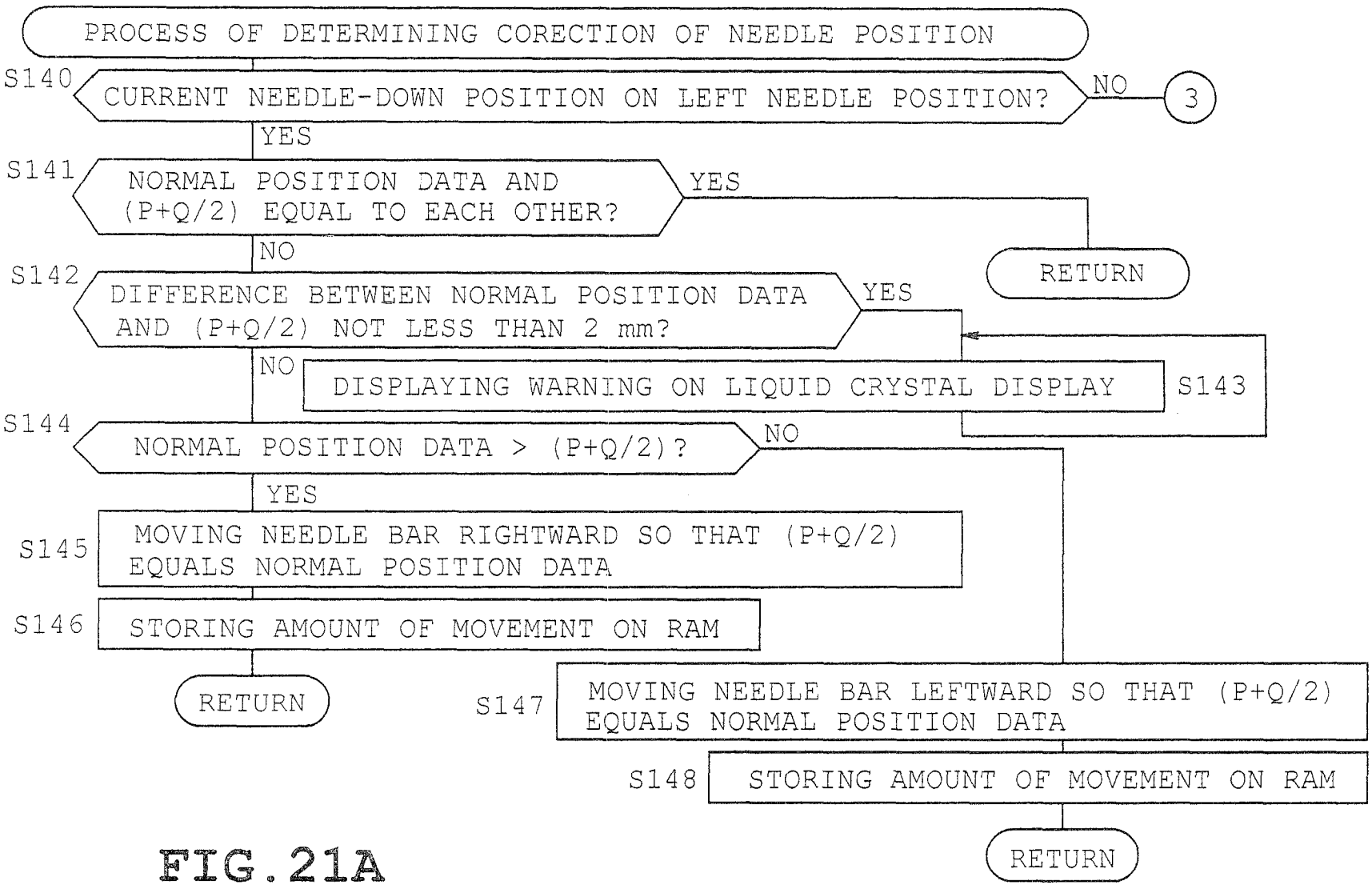
FIG. 21 is a flowchart showing in detail a process of determining correction of needle location as shown in FIG. 20.
Figure 21B:
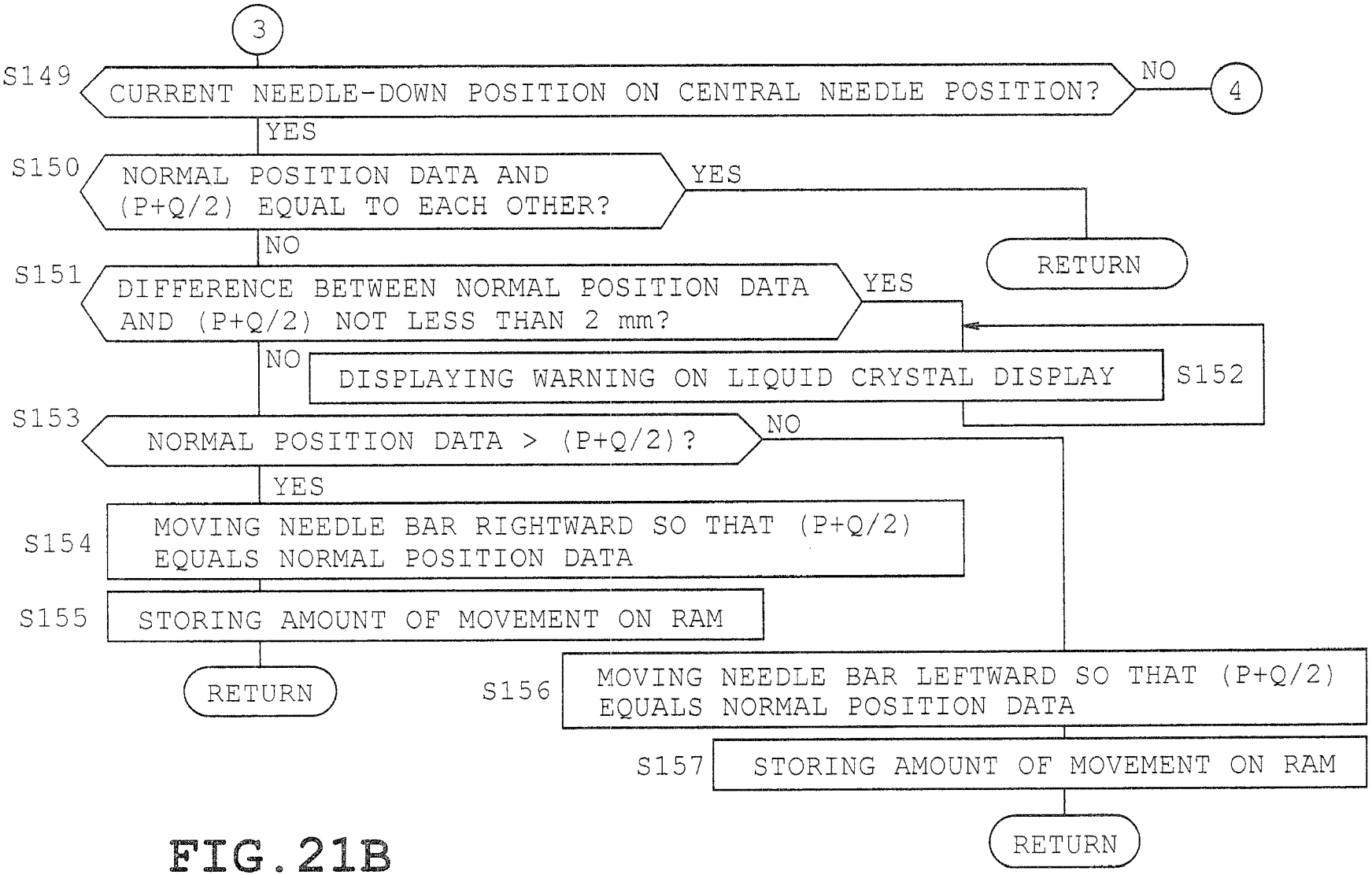
Figure 21C:
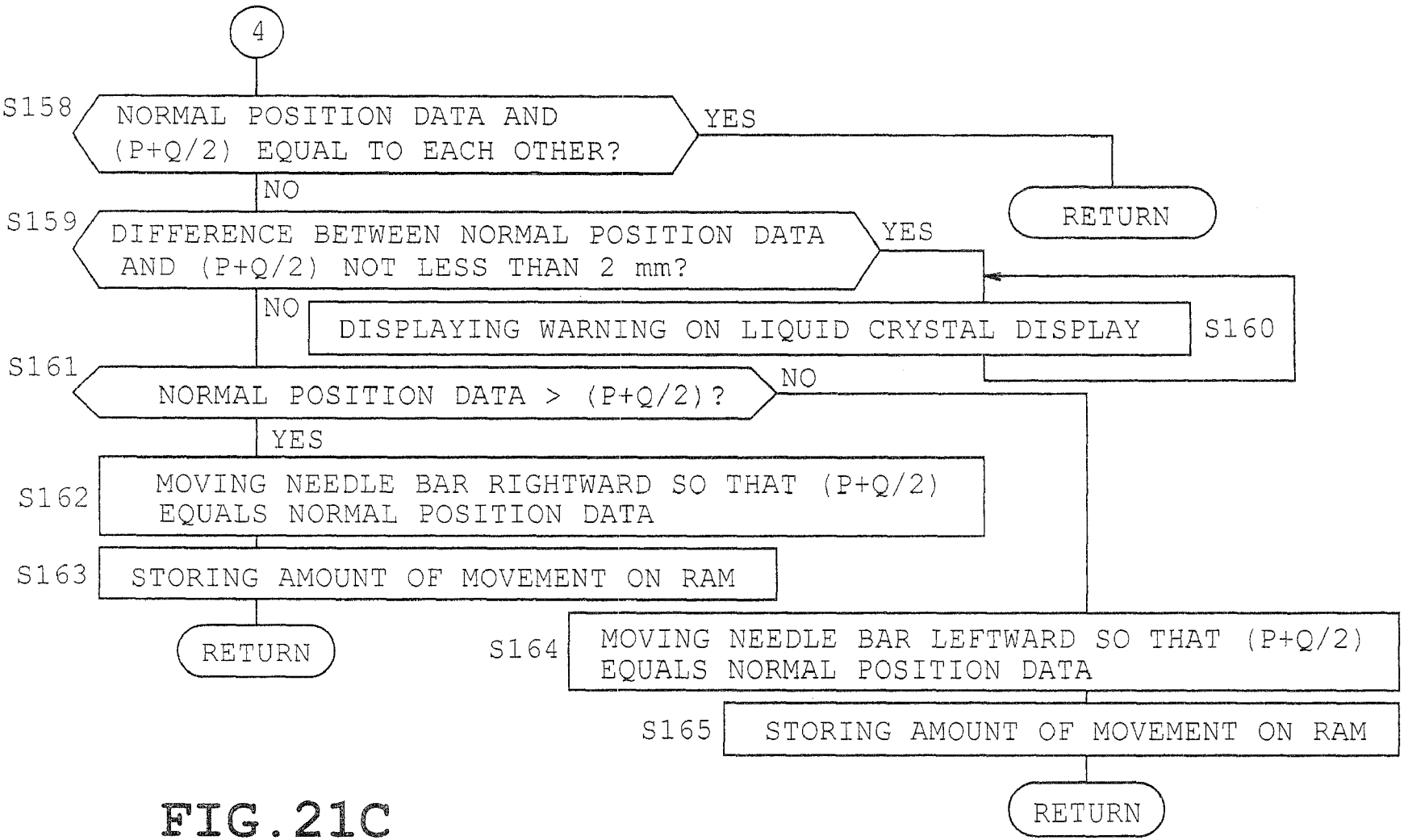

The needle position correction determining process is carried out for the single needle 61 (needle bar 5). Referring to FIGS. 21A to 21C, the needle position correction determining process is shown in detail. More specifically, the control device 22 determines at step S140 whether the single needle 61 (needle bar 5) is located at the left needle position. When the single needle 61 is located at the normal needle position (S140: YES), the control device 22 advances to step S141 to determine whether the value of (P+1/2·G) calculated from the left clearance P and the width Q and the normal position data of the left needle position are equal to each other. When the value of (P+1/2·G) and the normal position data are equal to each other (S141: YES), the control device 22 determines that the position of the single needle 61 is normal. In this case, the control device 22 returns to the main routine of FIG. 20, and the sewing operation is started by the operation of the start/stop key 16*a* by the user at step S135. The value of (P+1/2·G) indicates a clearance between a left end of the needle hole 11 and the center of the single needle 61.

When the value of (P+1/2·G) differs from the normal needle position in the case where the needle bar 5 is located at the left needle position (S141: NO), the control device 22 advances to step S142 to determine whether the difference between the value of (P+1/2·G) and the aforesaid normal needle position is not less than 2 mm. When the difference is not less than 2 mm (S42: YES), the control device 22 determines that the sewing machine M is defective, since the difference exceeds an allowable range of needle position correcting process. In this case, the control device 22 advances to step S143 to display warning on the liquid crystal display 17 and to activate the buzzer 34, whereby the user is prompted to repair the sewing machine M.

When the difference between the value of (P+1/2·G) and the normal needle position is less than 2 mm (S142: NO), the control device 22 advances to step S144 to determine whether the normal position data of the left needle position is larger than the value of (P+1/2·G). When the normal position data of the left needle position is larger than the value of (P+1/2·G) (S144: YES), the control device 22 advances to step S145. The stepping motor 13 is driven or positive-direction pulses are applied to the stepping motor 13 until the value of (P+1/2·G) becomes equal to the normal data, thereby moving the needle bar 5 (the single needle 61) rightward.

At next step S146, data of an amount of movement (the number of correcting pulses) of the needle bar 5 moved by the drive of the stepping motor 13 is stored on the RAM 28. The control device 22 then returns to the main routine of FIG. 20 to start sewing by the operation of the start/stop key 16*a* by the user. Since the amount of movement is stored on the RAM 28, the needle position of the needle bar 5 (the single needle 61) is retained at the normal left needle position.

When determining at step S144 that the normal position data of the left needle position is not more than the value of (P+1/2·G) (S144: NO), the control device 22 advances to step S147 to drive via the drive circuit 32 the stepping motor 13 or negative-direction pulses are applied to the stepping motor 13, whereby the needle bar 5 (the single needle 61) is moved leftward. At next step S148, data of an amount of movement of the needle bar 5 moved by the drive of the stepping motor 13 is stored on RAM 28 (see FIG. 6). The control device 22 then returns to the main routine of FIG. 20. At step S135, the sewing operation is started by the operation of the start/stop key 16*a* by the user. Since the amount of movement is stored on the RAM 28, the needle position of the needle bar 5 (the single needle 61) is retained at the normal left needle position. The sewing operation is stopped by the operation of the start/stop key 16*a* by the user (S137) upon execution of a predetermined amount thereof (S136).

On the other hand, when the single needle 61 is located at the left needle position at step S140 (S140: NO), the control device 22 advances to step S149 to determine whether the needle bar 5 is located at the central needle position (S149: YES), the same processing is executed as where the needle bar 5 is located at the left needle position. At steps S150 to S157, the same processing is executed as at the steps S141 to S148 with only difference in the normal position data. Accordingly, the detailed description is eliminated. Furthermore, when the needle bar 5 is not located at the central needle position (S149: NO), that is, when the needle bar 5 is located at the right needle position, the same processing is executed as when the needle bar 5 is located at the left needle position. At steps S158 to S165, the same processing is executed as in the steps S141 to S148 with only difference in the normal position data. Accordingly, the detailed description is eliminated.

Figure 22:
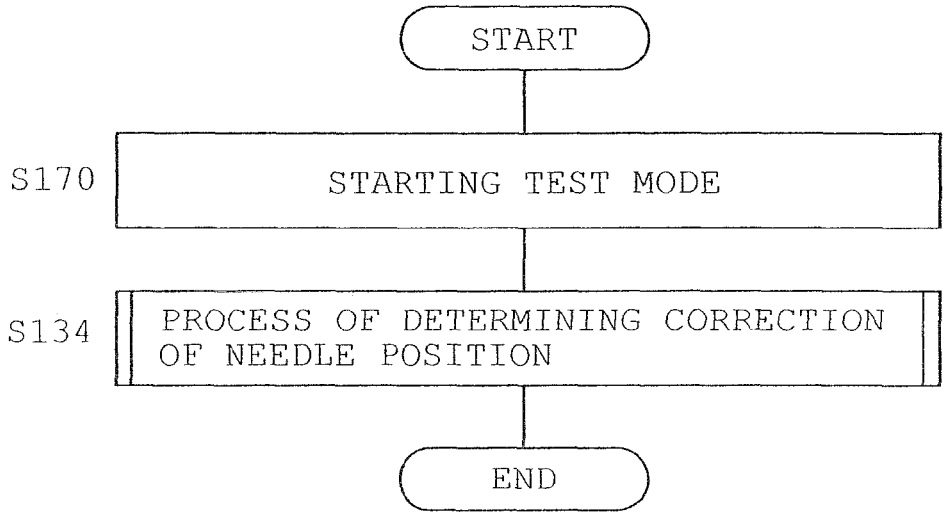
FIG. 22 is a flowchart similar to FIG. 8, showing a test mode.

Furthermore, in the example, the sewing machine M is provided with a test mode as shown in FIG. 22. More specifically, when the user operates the touch panel 18 to start the test mode (S170), the same needle position correction determining process (S134) as described above is carried out. As the result of provision of the test mode, the needle bar 5 (the single needle 61) can be corrected so as to be located at a predetermined normal position during factory shipment or maintenance and inspection of products of sewing machine M.

In the above-described fourth example, an actual positional relation between the needle hole 11 and the single needle 61 can directly be detected based on the images of the needle hole 11 and the single needle 61 obtained by the image sensor 23. As a result, even when the single needle 61 is, located at any one of the left, central and right needle positions L, C and R, it can reliably be determined whether the position at which the needle bar 5 is located is a normal position, whereupon the positional correction can be carried out desirably. This can prevent the defect such as the interference between the needle plate 102 and the single needle 61 due to displacement of the needle position of the single needle 61 from the normal position.

Whether the single needle 61 is located at the normal position is determined based on the clearance P from the single needle 61 to the left end of the needle hole 11 and the width Q of the single needle 61 both obtained by calculation. Accordingly, various types of single needles with different widths can be used as the single needle 61, and the determination regarding the normal position of the single needle 61 can be rendered more reliable. Furthermore, when the single needle 61 is displaced from the normal position by 2 mm or above, the warning device comprising the liquid crystal display 17 and the buzzer 34 can quickly inform the user of an abnormal condition. Thus, the user can take an appropriate measure against the abnormal condition.

The positional data of the corrected needle position of the single needle 61, that is, an amount of movement of the needle position of the single needle 61 is stored n the RAM 28. Accordingly, the sewing operation can be carried out with the needle bar 25 being normally located at the normal position.

FIGS. 23 to 26 illustrate the fifth example. In the fifth example, the single needle 61 is attached to the needle bar 5 as in the fourth example. However, the fifth example differs from the fourth example in the software configuration or the control contents of the control device 22.

Figure 23:
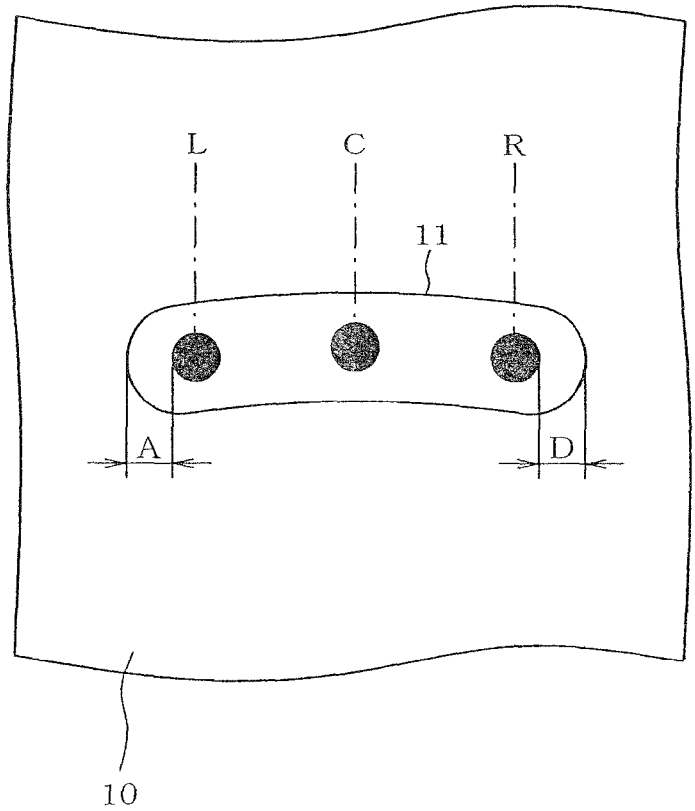
FIG. 23 is a view similar to FIG. 19, showing the relationship between the needle hole and needle locations in a fifth illustrative example of the disclosure.

The control device 22 calculates the left clearance P between the single needle 61 and the left end of the needle hole 11 in the state where the needle position of the single needle 61 has been moved to the left needle position, based on the extracted contour images, as shown in FIG. 23. The control device 22 also calculates the right clearance D between the single needle 61 and the left end of the needle hole 11 in the state where the needle position of the single needle 61 has been moved to the right needle position, based on the extracted contour images. The control device 22 determines whether the needle position is a normal position, based on the calculated right and left clearances D and P.

Figure 24:
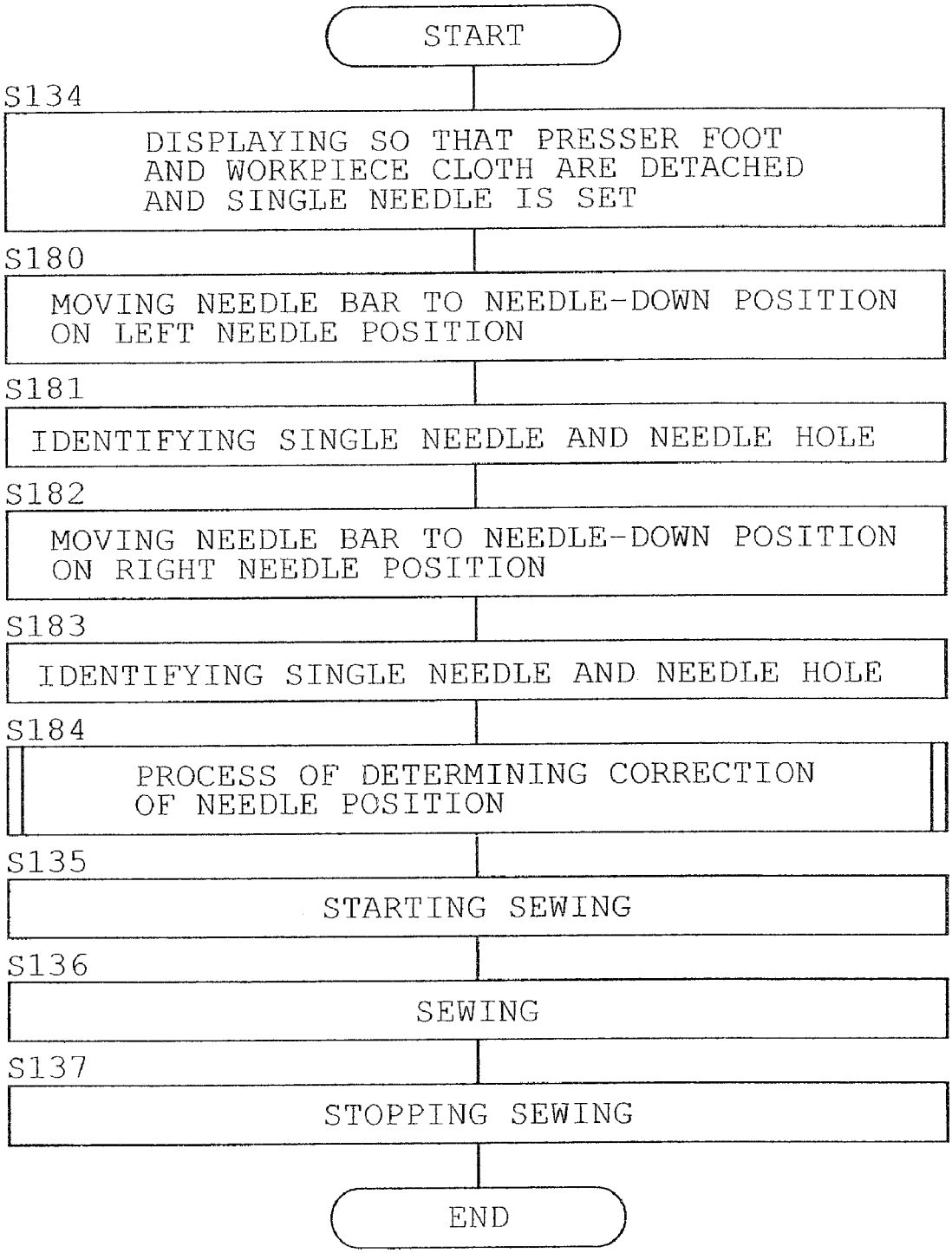
FIG. 24 is a flowchart similar to FIG. 20.
Figure 25:
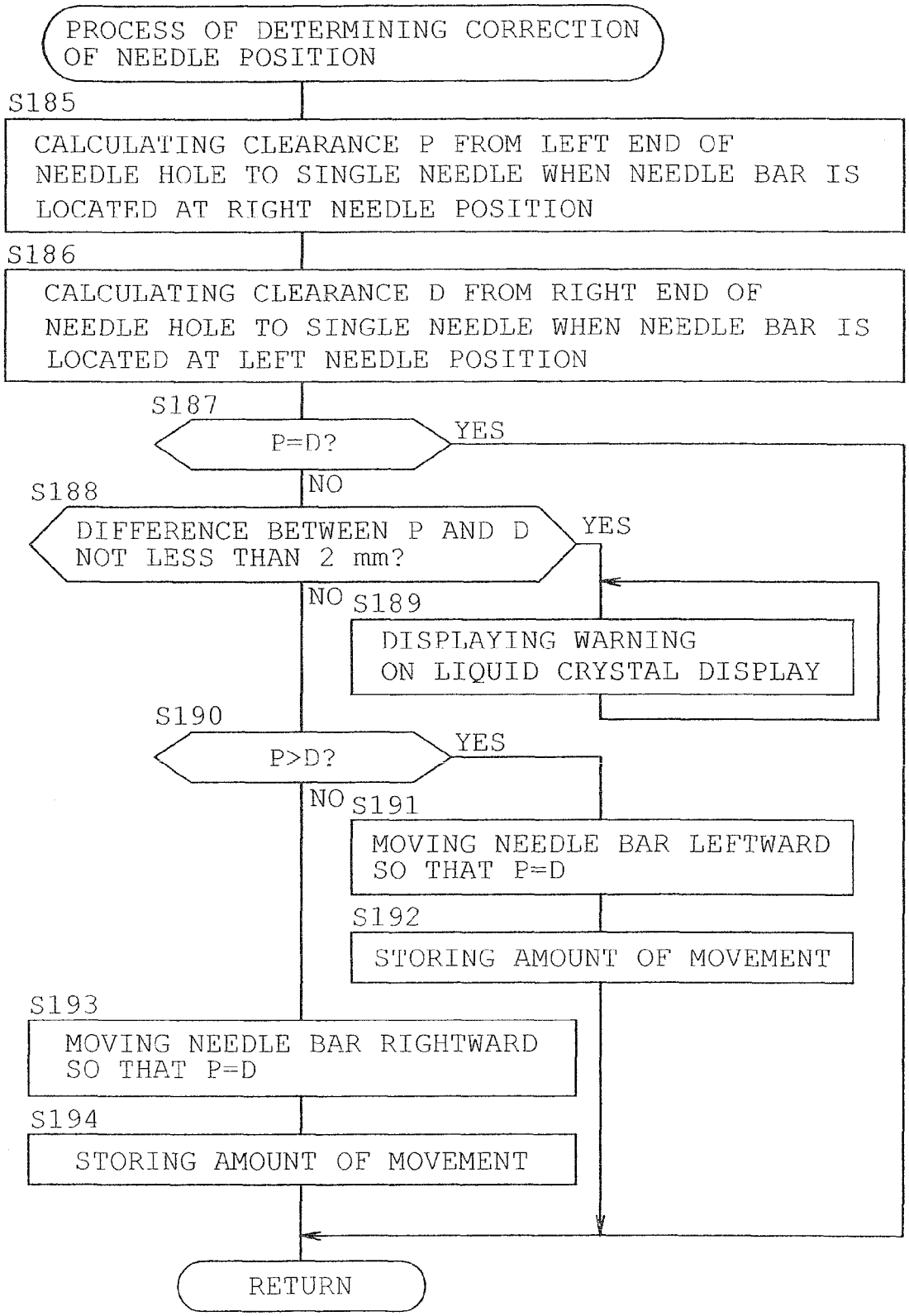
FIG. 25 is a flowchart showing in detail a process of determining needle location correction as shown in FIG. 24.
Figure 26:
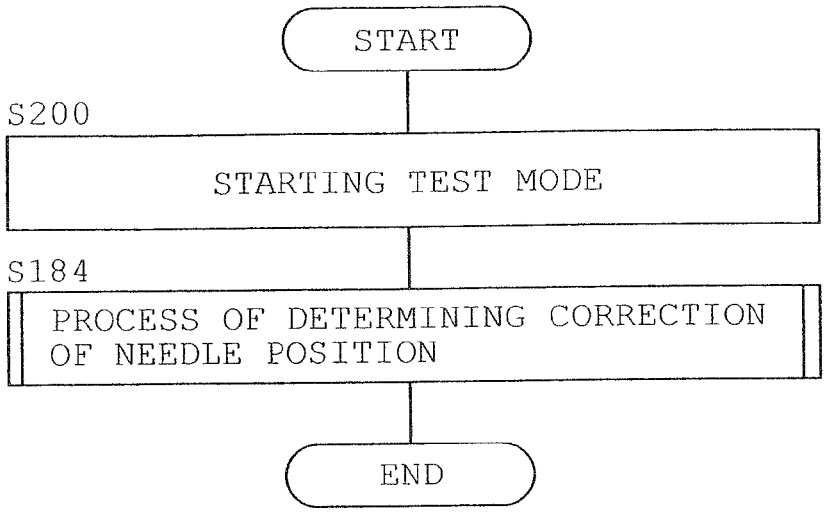
FIG. 26 is a flowchart similar to FIG. 22.

Referring to FIG. 24, the entire control procedure (main routine) executed by the control device 22 is shown. When the sewing machine M is powered on, the needle bar 5 is stopped at a position corresponding to any one of the left, central and right needle positions L, C and R according to the currently selected stitch pattern. Firstly, at step S131, the control device 22 activates via the drive circuit 20 the liquid crystal display 17 so that a message is displayed, in order that the user may be prompted to detach the presser foot 6, to remove the workpiece cloth from the upper surface of the needle plate 10 and to attach the single needle 61.

The control device 22 then drives the stepping motor 13 and accordingly the needle bar rocking mechanism 14 so that the needle bar 5 is moved to the left needle position, at step S180. With this, the control device 22 drives the sewing machine motor 12 so that the needle bar 5 (the single needle 61) is moved downward to the needle-down position (needle position). At step S181, the single needle 61 and the needle hole 11 are imaged by the image sensor 23. The obtained image data is converted to an image substantially as a front view and thereafter, arithmetic processing is executed based on data obtained by the contour (edge) extracting process, so that the contour images of the needle hole 11 and the single needle 61 located at the left needle position are obtained.

Subsequently, at step S182, the needle bar rocking mechanism 14 is driven so that the needle bar 5 is moved to the right needle position, and the sewing machine motor 12 is driven so that the single needle 61 is moved downward to the needle-down position (needle position). Subsequently, at step S183, the single needle 61 and the needle hole 11 are imaged by the image sensor 23. The obtained image data is converted to an image substantially as a front view and thereafter, arithmetic processing is executed based on data obtained by the contour (edge) extracting process, so that the contour images of the needle hole 11 and the single needle 61 located at the right needle position are obtained.

The needle position correction determining process is carried out for the single needle 61 (needle bar 5) at step S184. The needle position correction determining process will be described with reference to FIG. 25. At step S185, the left clearance P from the left end of the needle hole 11 to the single needle 61 is calculated based on the contour images of the single needle 61 located at the left needle position and the needle hole 11 obtained at step S181. At step S186, the right clearance D from the right end of the needle hole 11 to the single needle 61 is calculated based on the contour images of the single needle 61 located at the right needle position and the needle hole 11 obtained at step S183.

Subsequently, the values of the right and left clearances D and P are compared with each other, and the subsequent processing is carried out according to the result of comparison. Firstly at step S187, the control device 22 determines whether the right and left clearances D and P are equal to each other. When determining that the right and left clearances D and P are equal to each other (S187: YES) and accordingly that the needle position of the single needle 61 (the needle bar 5) is normal (the normal position), the control device 22 advances to step S135 where sewing is started by operation of the start/stop key 16*a* by the user. When determining that the right and left clearances D and P differ from each other (S187: NO), the control device 22 advances to step S188.

At step S188, the control device 22 determines whether the difference between the right and left clearances D and P is not less than 2 mm. When the difference between the clearances D and P is not less than 2 mm (S188: YES), the control device 22 determines that the difference exceeds an allowable range of the needle position correction determining process and accordingly that the sewing machine M is defective. In this case, the control device 22 advances to step S189 to display warning about the defect on the display 17 and to activate the buzzer 34. As a result, the user is prompted to repair the sewing machine. When the difference between the clearances D and P is less than 2 mm (S188: NO), the control device 22 advances to step S190.

At step S190, the control device 22 determines whether the left clearance P is larger than the right clearance D. When the left clearance P is larger than the right clearance D (S190: YES), the single needle 61 (the needle bar 5) is located rightward from the normal position. The control device 22 then drives the stepping motor 13 or applies negative pulses to the stepping motor 13 so that the needle bar 5 (the single needle 61) is moved leftward (S191). At step S192, data of an amount of movement of the needle bar 5 is stored on the RAM 28. Subsequently, the control device 22 returns to the main routine of FIG. 24 to carry out the processes at steps S135 to S137.

In the fifth example, the sewing machine M is provided with the test mode as in the fourth example. More specifically, the user operates the touch panel 18 to start the test mode (S200), and the needle position correction determining process (S184) as described above is carried out.

In the above-described fifth example, the control device 22 obtains the left clearance P from the left end f the needle hole 11 to the single needle 61 located at the left needle position and the right clearance D from the right end of the needle hole 11 to the single needle 61 located at the right needle position. The control device 22 can reliably determine whether the needle position corresponds to the normal position, based on the correspondence and magnitude relation between the right and left clearances D and P. Consequently, the single needle 61 (the needle bar 5) can reliably be located at the normal position.

The above-described fourth and fifth examples exemplify concrete numeric values such as the width (0.9 mm) of single needle 61 or the threshold (2 mm) in the determination about the defect in the needle position (S142, S151, S169 and S188) in the needle position correction determining process (S134 and S184), and various thresholds according to types of sewing machines or the like may be set.

In the fourth example, when the needle bar 5 (the single needle 61) is located at any one of the left, central and tight needle positions L, C and R, the needle position correction determining process (S134) is carried out for the normal position corresponding to each of the needle positions. However, the needle position correction determining process should not be limited to the above-described manner. For example, when the needle bar 5 (the single needle 61) is located at either left or right needle position, the needle position correction determining process may be carried out for each of the normal positions corresponding to the two needle positions, instead. More specifically, the needle position correction determining process (S134) may not be carried out when the needle bar 5 (the single needle 61) is located at the central needle position. The single needle 61 does not almost interfere with the needle plate 10 when the needle bar 5 (the single needle 61) is located at the central needle position.

FIGS. 27 to 34 illustrate a sixth example. A button is sewn on the workpiece cloth by the sewing machine M in the sixth example. In the sixth example, the needle 61 such as the single needle is also attached to the needle bar 5 as in the fourth and fifth examples. A needle thread Ta passed through a needle bar guide 62 is further passed through a needle eye 62*a* of the needle 61. The other hardware construction of the sewing machine M in the sixth example is similar to that of the first example except for a presser foot. The sixth example differs from the first example in the control contents of the control device 22. Accordingly, identical or similar parts in the sixth example are labeled by the same reference symbols as those in the first and fourth examples, and new diagrammatic representation and detailed description about these parts will be eliminated. The differences of the sixth example from the first and fourth examples will be described in the following.

Figure 27:
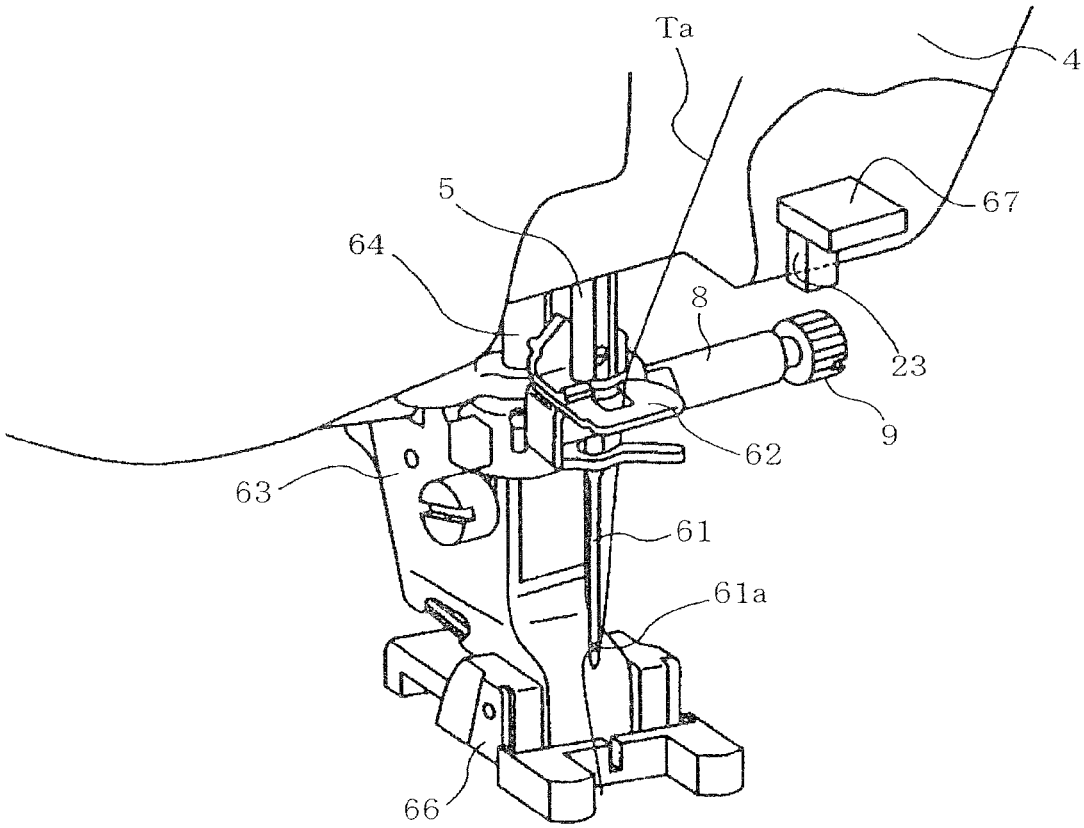
FIG. 27 is a view similar to FIG. 2, showing a sewing machine in accordance with a sixth illustrative example of the disclosure.

A button presser foot 66 is mounted on a presser holder 63, instead of the presser foot 6 as shown in FIG. 27. A button is held at the needle position by the button presser foot 66. The button presser foot 66 is accordingly used in button sewing in which a button is sewn onto a workpiece cloth. The button located on the workpiece cloth placed on the needle plate 10 is pressed to be held at a needle position by the button presser foot 66. The button presser foot 66 is made of a transparent synthetic resin so that a button held by the button presser foot 66 is imaged by the image sensor 23.

In the sixth example, the control device 22 is provided with a software configuration which images the button held by the button presser foot 66 to identify positions of two buttonholes. Based on the identified positions of the buttonholes, the control device 22 sets a rocking position of the needle bar 5 so that the needle 61 is passed through the buttonholes alternately. The control device 22 controls the needle bar rocking mechanism 14 based on the setting.

Describing in more detail, the control device 22 detects an interhole distance from the identified positions of the two buttons and sets a rocking position of the needle bar 5 according to the interhole distance. Furthermore, the control device 22 determines whether the buttonholes of the button held by the button presser foot 66 is located at a position where the button can be sewn onto the workpiece cloth. When determining that the buttonholes are not located at the aforesaid position, the control device 22 forbids the sewing operation.

Figure 28:
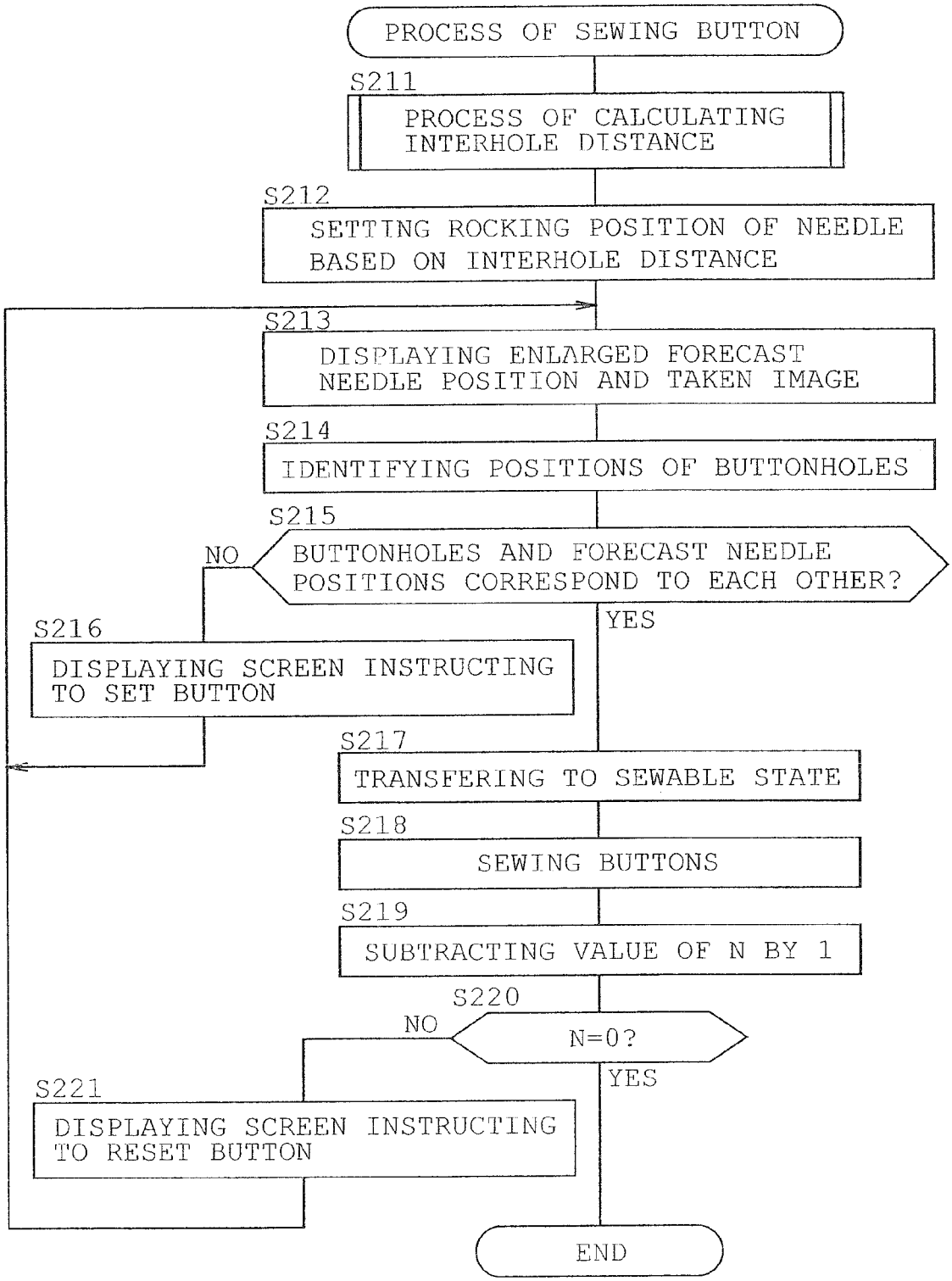
FIG. 28 is a flowchart showing a button sewing process.
Figure 29:
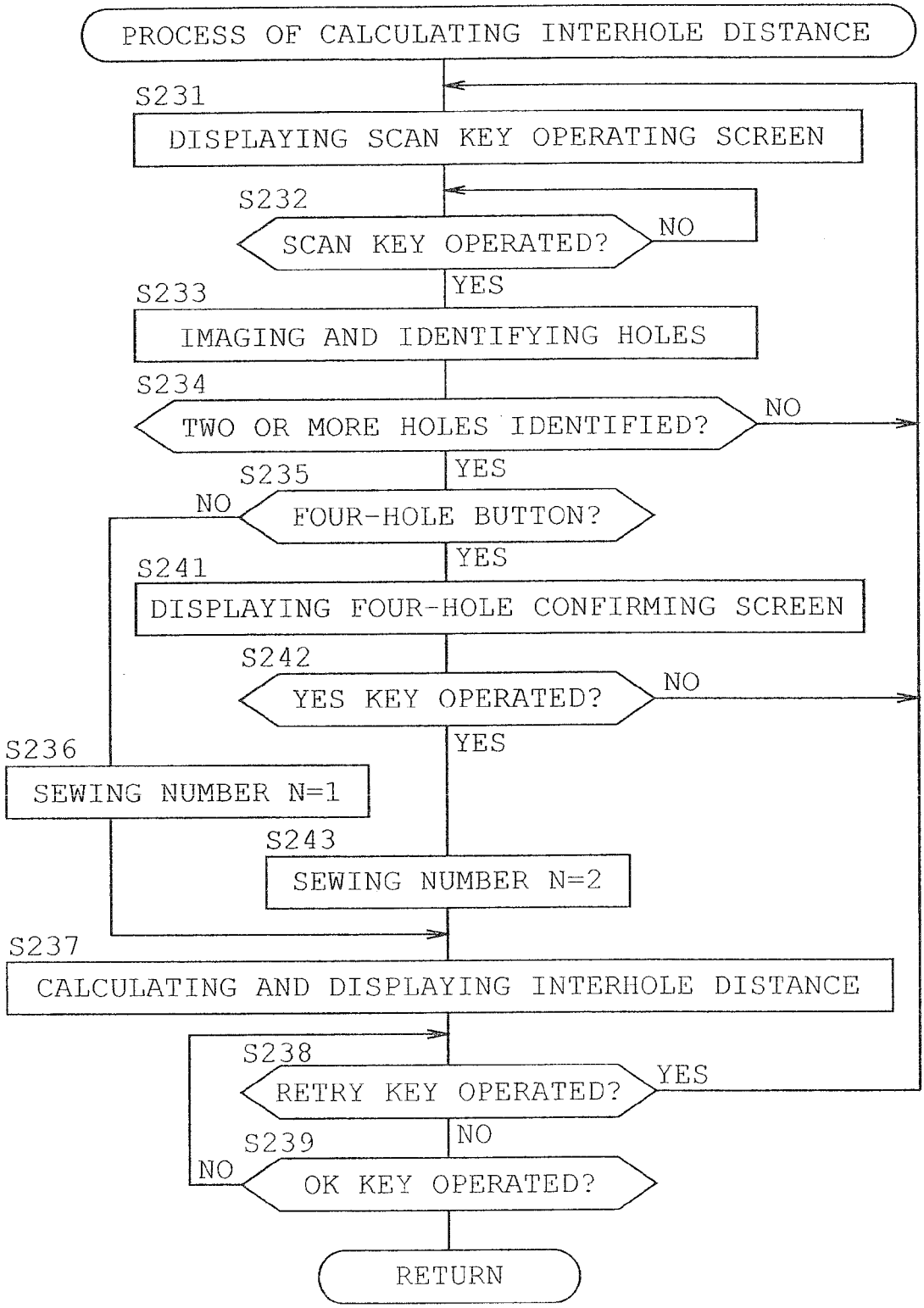
FIG. 29 is a flowchart showing a process of calculating an interhole distance executed during button sewing process.

The working of the sewing machine M will now be described with reference to FIGS. 28 to 34 as well as FIG. 27. When the user touches the touch panel 18 to select one of a plurality of patterns which is used to sew the button onto the workpiece cloth, the control device 22 executes a button sewing process as shown in the flowchart of FIG. 28 according to a program stored on ROM 27. More specifically, upon start of button sewing process, the control device 22 carries out an interhole distance calculating process at step S211. The flowchart of FIG. 29 shows the interhole distance calculating process in detail. The interhole distance is calculated from an image taken by the image sensor 23.

Figure 30:
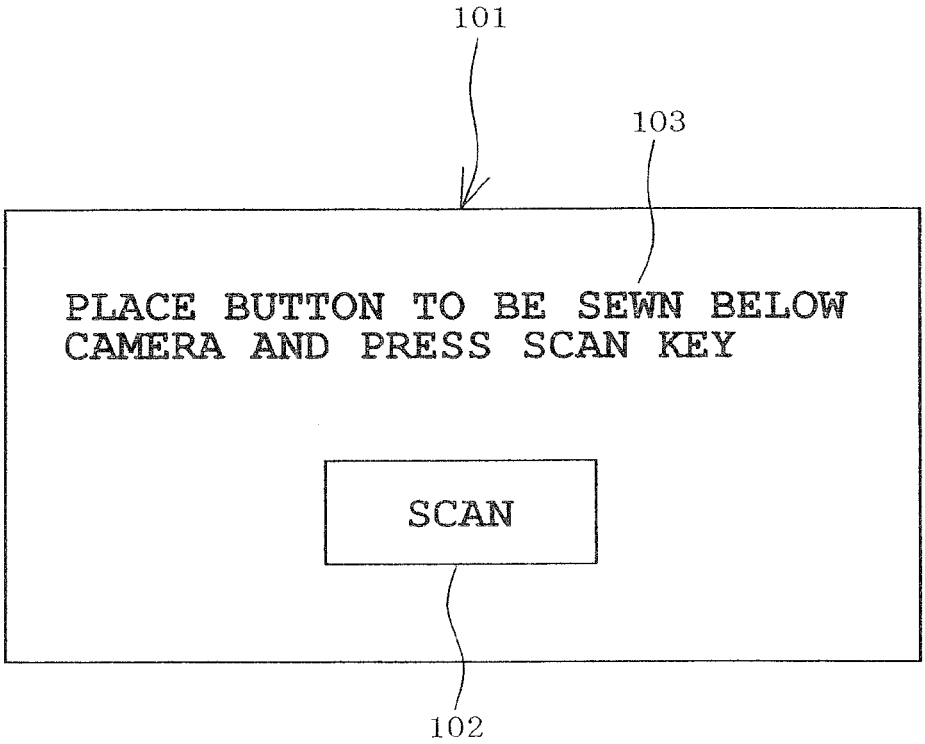
FIG. 30 shows a scan key operating screen.

Upon start of the interhole distance calculating process, a scan key operating image 101 (see FIG. 30) is displayed on the liquid crystal display 17 at step S231 as shown in FIG. 29. The scan key operating image 101 includes a scan key 102 and a message 103 as shown in FIG. 30. The scan key 102 is an operation key for instructing to image the button by the image sensor 23. The message prompts the user to place a button to be sewn on the workpiece cloth, below a camera (near the needle position).

Subsequently, the control device 22 advances to step S232 to determined whether the scan key 102 has been operated. The determination is repeated when the scan key 102 is not operated (S232: NO). When the user touches the touch panel to operate the scan key 102 (S232: YES), imaging by the image sensor 23 is carried out at step S233, so that the holes of the button are recognized. The buttonholes are recognized by a known image processing manner. More specifically, image data of the taken images is binarized and contours of the objects to be imaged are extracted. Contours indicative of the buttonholes are discovered in the extracted contours, whereby the buttonholes are identified. At step S234, the control device 22 determines whether two or more buttonholes have been identified. When two or more buttonholes have not been identified (S234: NO), the control device 22 determines that recognition of buttonholes has failed, returning to step S231.

When two or more buttonholes have been identified (S234: YES), the control device 22 advances to next step S235 to determine whether the button to be sewn on the workpiece cloth is a four-hole button. When the number of identified buttonholes is two but not four (S235: NO), the control device 22 advances to step S236 to store "1" as the value of a counter N indicative of the number of sewing operations in the button sewing. In the example, the needle bar 5 is moved upward and downward while being rocked by the needle bar rocking mechanism 14, so that the needle is passed through the two buttonholes alternately at a plurality of times, whereby the button is sewn onto workpiece cloth. The counter N indicates "1" as the number of sewing operations in the case where a button with two buttonholes is sewn onto the workpiece cloth. Accordingly, when a button with four buttonholes is sewn onto the workpiece cloth, the counter N indicates "2" as the number of sewing operations. The value of the counter N is used when a button is sewn onto the workpiece cloth, as will be described in detail later.

Figure 31:
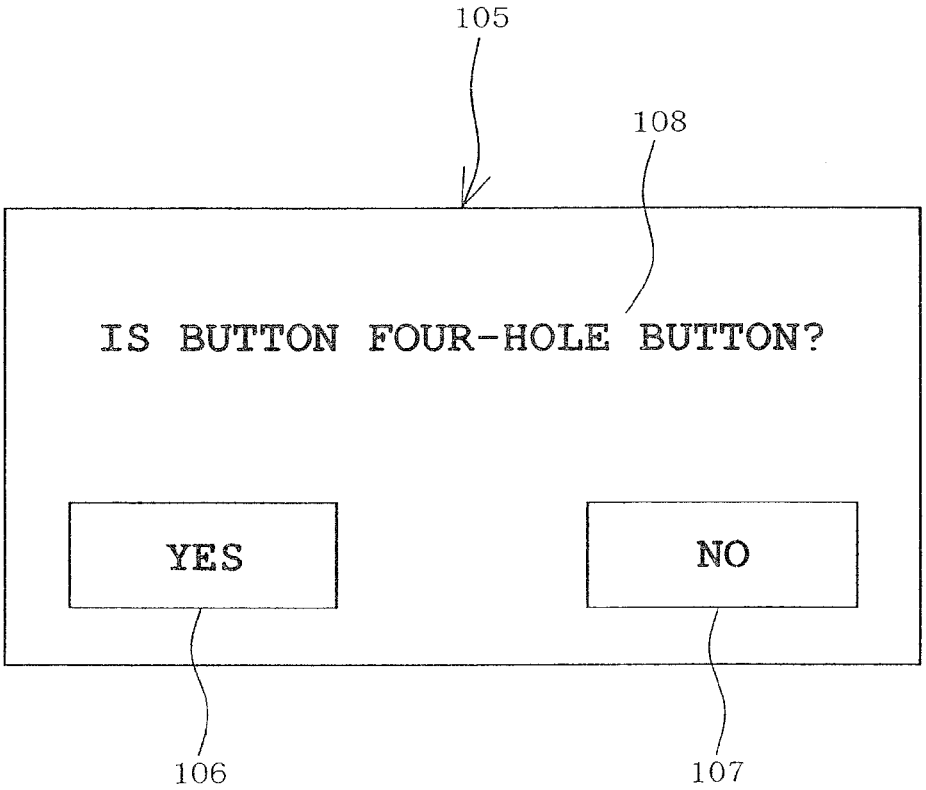
FIG. 31 shows a four-hole confirming screen.
Figure 32:
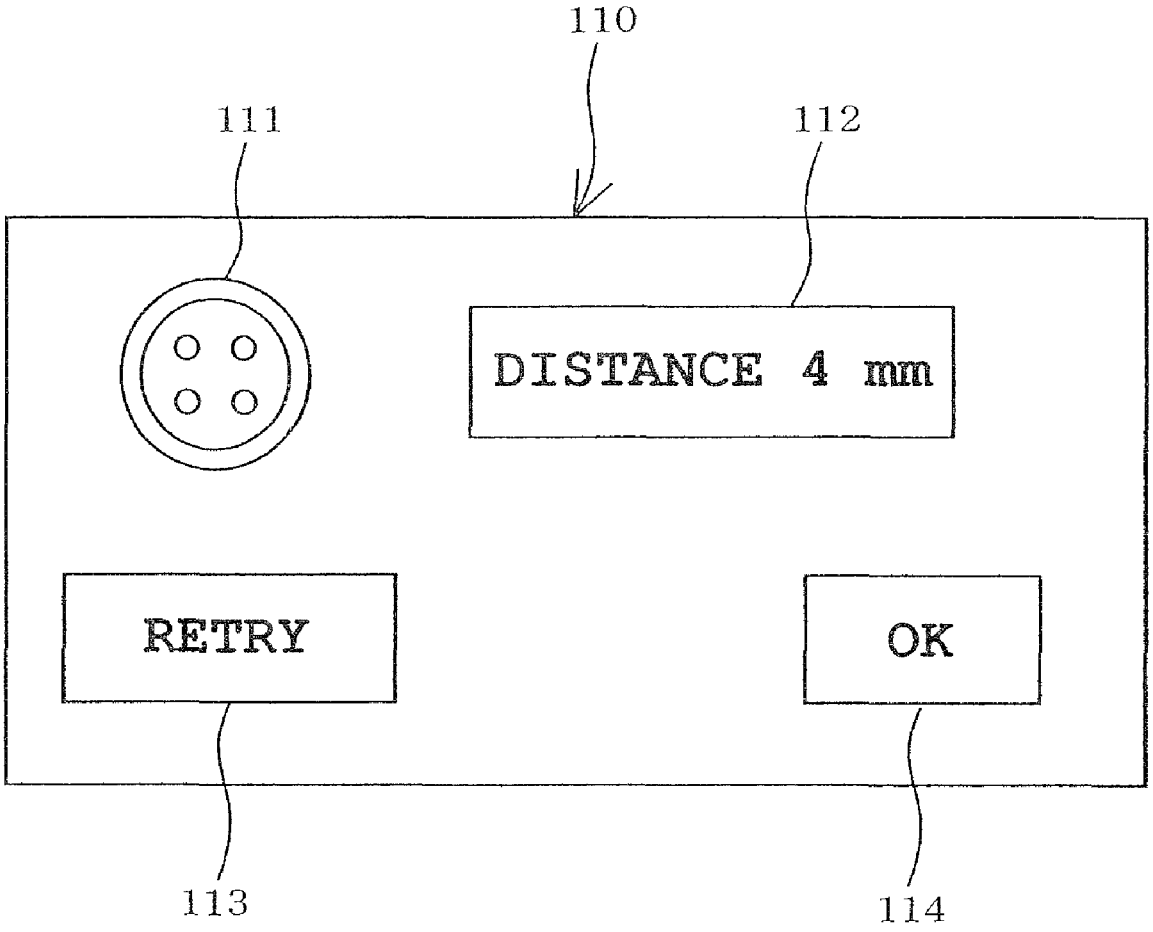
FIG. 32 shows an interhole distance displaying screen.

On the other hand, when the number of buttonholes identified by the image processing is "4" (S235: YES), the control device 22 advances to step S241 to display a four-hole confirmation screen 105 (see FIG. 31) on the liquid crystal display 17. The four-hole confirmation screen 105 includes a YES key 106, a NOT key 107 and a confirmation message 108 as shown in FIG. 31. The YES and NO keys 106 and 107 are used for the user to enter information as to whether the button to be sewn is a four-hole button. At step S242, the control device 22 determines which one of the keys 106 and 107 has been operated. When the NO key 107 has been operated (S242: NO), the control device 22 returns to step S231. When the YES key 106 has been operated (S242: YES), the control device 22 advances to step S243 to store "2" on the counter N as the number of sewing operations in the button sewing.

Subsequently, the control device 22 advances to step S237 to calculate an interhole distance between the two buttonholes and to display an interhole distance display screen 110. Calculation of the interhole distance is carried out by known image processing. More specifically, center points of two holes adjacent to each other are obtained by computing from the contours of the buttonholes discovered by the processing at step S233. The distance between two center points obtained by computation is stored as the interhole distance on RAM 28. Furthermore, the interhole distance display screen 110 includes a button image area 111, an interhole distance display area 112, a retry key 113 and an OK key 114. When the button has been determined to be a two-hole button, an image of two-hole button is displayed in the button image area 111 of the interhole distance display screen 110. When the button has been determined to be a four-hole button, an image of four-hole button is displayed in the button image area 111. An obtained interhole distance is displayed in the interhole distance display area 112 of the interhole distance display screen 110. The retry key 113 is operated by the user to enter instruction to obtain an interhole distance again. The OK key 114 is operated by the user to enter instruction to execute the next process.

Subsequently, the control device 22 advances to step S238 to determine whether the retry key 113 has been operated. When the retry key 113 has not been operated (S238: NO), the control device 22 advances to step S239 to determine whether the OK key 114 has been operated. When neither retry key 113 or OK key 114 has been operated (S238: NO and S239: NO), the control device 22 repeats the determination steps S238 and S239. When the retry key 113 has been operated (S238: YES), the control device 22 returns to step S231 to re-calculate the interhole distance. As a result, the button sewing can reliably be prevented from failing. When the OK key 114 has been operated (S239: YES), the control device 22 returns to the button sewing process in FIG. 28.

Upon completion of the interhole distance calculating process (S211), the control device 22 advances to step S212 to set a rocking position of the needle bar 5 based on the calculated interhole distance, as shown in FIG. 28. In the sewing machine M, the needle bar 5 is moved upward and downward while being rocked by the needle bar rocking mechanism 14, whereby the needle 61 is passed through the two buttonholes alternately so that the button is sewn onto the workpiece cloth. A rocking distance of the needle bar 5 is controlled by an amount of rotation (the number of pulses) of the stepping motor 13. An amount of rotation of the stepping motor 13 determined with the calculated interhole distance serving as a rocking distance, whereupon a rocking position of the needle bar 5 is set.

Subsequently, an anticipated needle position 121 and the image taken by the image sensor 23 are enlarged on the liquid crystal display 17. Described in more detail, the liquid crystal display 17 includes a taken image display area 120 in which an image of near-needle position imaged by the image sensor 23 is enlarged. Furthermore, two anticipated needle positions 121 of the needle 61 are determined from the rocking position of the needle bar 5 set on the basis of the interhole distance, being displayed in the taken image display area 120. Accordingly, the user can fix the button 126 by moving the button presser foot 66 and the position of two buttonholes 127 of the button 126 correspond with each other, while viewing the enlarged images. As a result, the button 126 can easily be positioned.

Figure 33:
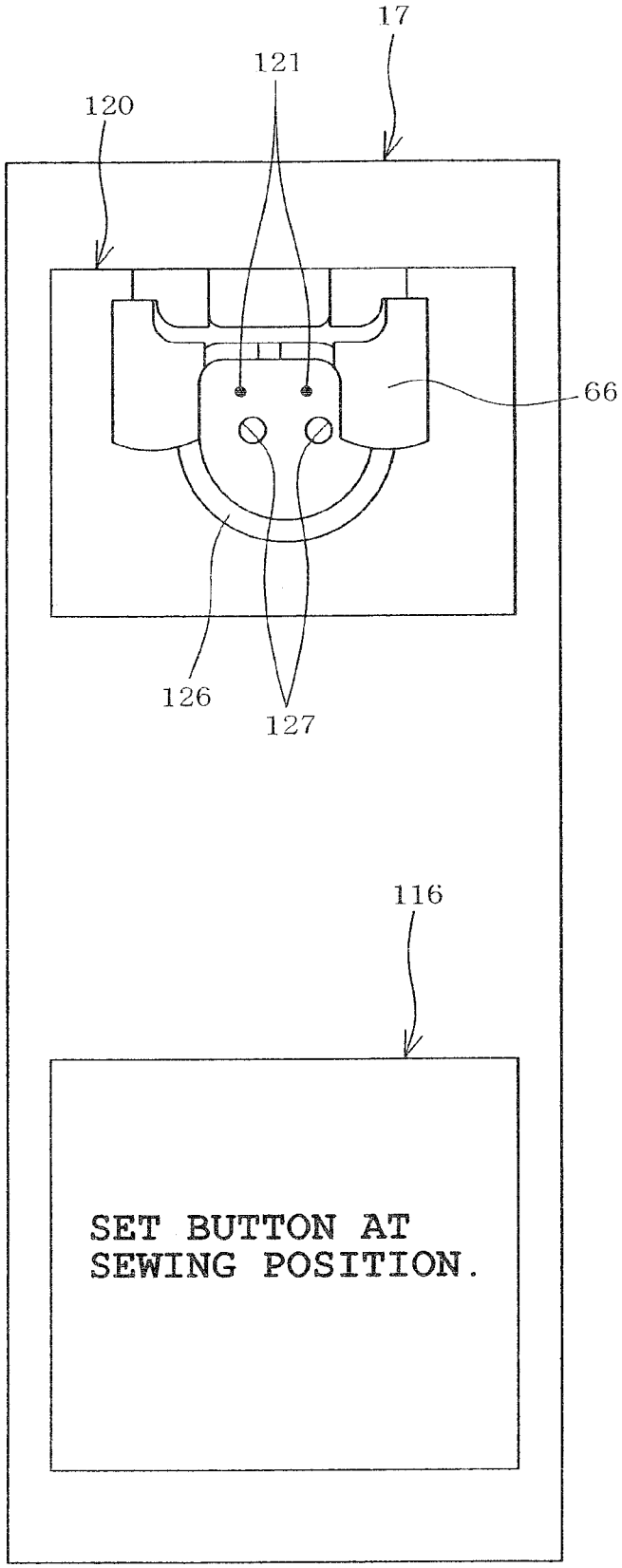
FIG. 33 shows a liquid crystal display displaying a button set instructing screen and a photographed image displaying section.

Subsequently, the control device 22 advances to step S214 where the position of the buttonholes 127 of the buttonhole 126 is identified by image processing. The control device 22 then advances to step S215 to determine whether the displayed anticipated needle position and the position of two buttonholes 127 of the button 126 correspond with each other. When the displayed anticipated needle position and the position of two buttonholes 127 of the button 126 do not correspond with each other (S215: NO), the sewing machine M is disallowed to be put into a sewable state. The control device 22 advances to step S216 where a button set instructing screen 116 includes a message that "Set the button at a sewing position" as shown in FIG. 33.

When determining that the displayed anticipated needle position and the position of two buttonholes 127 of the button 126 correspond with each other (S215: YES), the control device 22 advances to step S217 to change the color of an LED (not shown) mounted on the start/stop key 16*a* from the read to the green. The control device 22 further advances to step S218 where the known button sewing is carried out when the start/stop key 16*a* is operated. In the button sewing, the needle bar 5 is moved upward and downward while being rocked, so that the needle 61 is passed through the two buttonholes 127 alternately, whereby the button 126 is sewn onto the workpiece cloth, as described above. Thus, the needle bar 5 is moved upward and downward while being rocked at the rocking position set based on the interhole distance between the buttonholes 127, whereby the button 126 is smoothly sewn onto the workpiece cloth.

Figure 34:
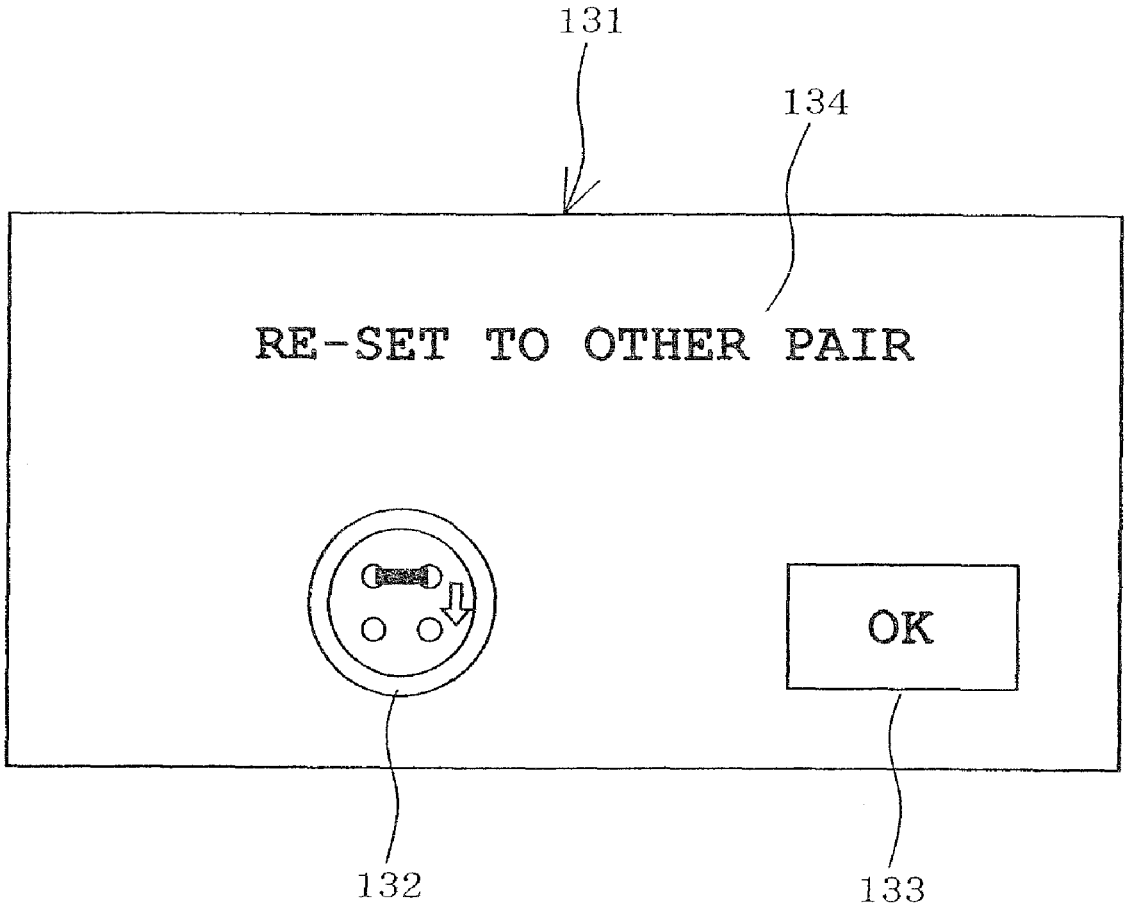
FIG. 34 shows a button reset instructing screen.

Upon completion of button sewing, the control device 22 advances to step S219 where the value of the counter N counting the number of sewing operations is subtracted by "1." The control device 22 further advances to step S220 to determine whether the value of counter N is at "0." When the value of counter N is not at "0" (step S220: NO), sewing for one of two pairs of buttonholes has been completed and accordingly, the needle 61 needs to be passed through the other pair. At step S221, a button re-set instructing screen 131 as shown in FIG. 34 is displayed on the liquid crystal display 17. The button re-set instructing screen 131 includes a movement image area 132 prompting movement of the button, an OK key 133 operated by the user to enter instruction to execute the next process and a button re-set message 134. Upon operation of the OK key 133, the control device 22 returns to step S213 to re-carry out a sequence of processing for button sewing (S213 to S220). When the value of counter N is "0" (S220: YES), the button sewing process is completed.

In the sixth example, the buttonholes are imaged by the image sensor 23, and the obtained image is processed so that the positions of at least two of the buttonholes are identified. Based on the identified positions of the buttonholes, the control device 22 sets the rocking position of the needle bar 5 so that the needle 61 is passed through the buttonholes alternately, thereby driving the needle bar rocking mechanism 14. Accordingly, the user need not manually set the rocking position of the needle bar 5 according to the positions of the buttonholes, whereupon the button can easily be sewn onto the workpiece cloth. Furthermore, when the user sets the rocking position of the needle bar 5, there is a possibility that the user may make an error in setting the rocking position, but the positions of the buttonholes can be identified accurately. Accordingly, since the needle bar 5 is rocked appropriately according to the positions of the buttonholes, the button can be sewn onto the workpiece cloth without contact of the needle 61 with the button.

Furthermore, the interhole distance between the two buttonholes is calculated, and the rocking position of the needle bar 5 is set according to the obtained interhole distance. As a result, the rocking position of the needle bar 5 can quickly be set by simple processing. Furthermore, the anticipated needle position is determined from the set rocking position of the needle bar 5. The control device 22 determines whether the displayed anticipated needle position and the position of two buttonholes 127 of the button 126 correspond with each other. The button sewing is executed only when the displayed anticipated needle position and the position of two buttonholes 127 of the button 126 correspond with each other. Consequently, failure in the sewing can reliably be prevented. Furthermore, the button set instructing screen 116 is displayed when the displayed anticipated needle position and the position of two buttonholes 127 of the button 126 do not correspond with each other. Accordingly, the user can readily understand whether the button sewing is executable. Additionally, the anticipated needle position 121 and the image taken by the image sensor 23 can be enlarged on the liquid crystal display 17. Consequently, the user can position the button easily and safely by viewing the image displayed on the liquid crystal display 17 without viewing the root of the needle 61.

The construction and processing manners of the sewing machine M in the sixth example should not be restrictive, and various modifications can be made. Firstly, the interhole distance between two buttonholes is calculated in the sixth example. The rocking position is set so that the needle bar 5 is rocked by the calculated interhole distance. Thereafter, the button sewing is carried out when the buttonholes are located at the anticipated needle position 121 (see FIG. 33) determined from the set rocking position. More specifically, one of the two needle positions is fixed in the case where the needle bar 5 is rocked and only the other needle position is set according to the interhole distance. As a result, the rocking position of the needle bar 5 can be set using only the interhole distance of the buttonholes so that the needle 61 is passed through the two buttonholes alternately. However, the rocking position f the needle bar 5 can be set without calculating the interhole distance. For example, an amount of rotation of the stepping motor 13 of the needle bar rocking mechanism 14 is controlled so that two needle positions in the case where the needle bar 5 is rocked are rendered optionally changeable. Center points of the buttonholes are identified by image processing after the button has been held by the button presser foot 66. The rocking position of the needle bar 5 may be set so that the needle 61 is passed through the identified center points of the buttonholes. In this case, since the user need not place the button so that the buttonholes are located at the anticipated needle positions 121, the button can easily be sewn onto the workpiece cloth.

Furthermore, it is desirable to calculate a distance between the center points of the buttonholes when the interhole distances of the buttonholes are calculated. Consequently, the possibility of contact of the needle 61 with the button can further be reduced. However, the above-described effect can be achieved even when the shortest distance between buttonholes of the button or the like is calculated.

Furthermore, whether the sewing machine M is sewable is determined by determining the anticipated needle position 121 is within the buttonhole 127 (see S215 and FIG. 28). However, for the purpose of simplifying the processing, it may be determined only whether the anticipated needle positions 121 and the buttonholes 127 correspond with each other in the front-rear direction of the sewing machine M (the up-down direction with respect to the image displaying area 120 in FIG. 33). Furthermore, when the sewing machine M is rendered sewable, the color of light emitted by the LED provided in the start/stop key 16*a* is changed from the red to the green, whereby the user is informed of the sewable condition of the sewing machine M. However, a message informing of the sewable condition of the sewing machine M may be displayed on the liquid crystal display 17. Furthermore, a loudspeaker (not shown) may be provided so as to produce sound which informs the user of the sewable condition of the sewing machine M, instead of the message displayed on the liquid crystal display 17. Furthermore, the contents of various messages displayed on the liquid crystal display 17 may be changed arbitrarily. The arrangement of various operation keys and the like may also be changeable.

The button presser foot 66 presses the button against the workpiece cloth thereby to be fixed in the sixth example. However, the button presser foot may comprise two elastic plates vertically sandwiching the button, instead.

The above-described examples should not be restrictive, but may be modified as follows. For example, although the first to sixth examples are directed to the household sewing machines, one or more examples may be directed to industrial sewing machines, instead.

The stepping motor 13 is employed as the drive source of the needle bar rocking mechanism 14 in the first to sixth examples. However, a solenoid may be provided as the drive source of the needle bar rocking mechanism 14, instead.

The image sensor 23 comprises a small imaging device of the CMOS type in the first to sixth examples. However, a small-sized imaging device of the charge coupled device (CCD) type may be used, instead.

The data of amount of movement of the needle bar 5 is stored on RAM 28 (see FIG. 6) in each of the foregoing examples. An electrically erasable and programmable read only memory (EEPROM) 29 may be provided, instead.

The foregoing description and drawings are merely illustrative and are not to be construed in a limiting sense. Various changes and modifications will become apparent to those of ordinary skill in the art. All such changes and modifications are seen to fall within the scope as defined by the appended claims.

What is claimed is:

1. A sewing machine comprising:

a needle bar to which a needle is attached;

a needle bar rocking mechanism which rocks the needle bar;

a needle plate having a needle hole through which the needle is insertable;

an imaging device which images a lower part of the needle bar;

a setting section which sets a range of rocking motion of the needle bar based on an image obtained by the imaging device; and a control device which controls the needle bar rocking mechanism based on the range of rocking motion set by the setting section.

2. A sewing machine comprising:

a needle bar to which a needle is attached;

a needle bar rocking mechanism which rocks the needle bar;

a needle plate having a needle hole through which the needle is insertable;

an imaging device which images a lower part of the needle bar;

an extracting section which extracts contour images of the needle hole and the needle based on an image obtained by the imaging device; and a control device which controls a range in which the needle bar is allowed to be rocked by the needle bar rocking mechanism, based on the contour images extracted by the extracting section.

3. The sewing machine according to claim 2, further comprising a determining section which determines whether the needle bar assumes a predetermined normal position relative to the needle hole, according to the contour images extracted by the extracting section, and a correction control device which controls the needle bar rocking mechanism so that the needle bar is moved to the normal position, according to a result of determination by the determining section.

4. The sewing machine according to claim 3, wherein:

the plural needles are allowed to be attached to the needle bar;

when the needle bar a position corresponding to a right or left baseline, the determining section calculates a horizontal distance between one of the needles assuming a rightmost or leftmost position and a right or left end of the needle hole and a width of said one needle; and the determining section determines whether the needle bar assumes the normal position, based on the calculated distance and the calculated width of said one needle.

5. The sewing machine according to claim 3, wherein:

the plural needles are allowed to be attached to the needle bar;

based on the contour images extracted by the extracting section, the determining section calculates a right clearance between the needle and a right end of the needle hole in a case where the needle bar assumes a position corresponding to a right baseline and a left clearance between the needle and a left end of the needle hole in a case where the needle bar assumes a position corresponding to a left needle position; and the determining section determines whether the needle bar assumes the normal position, based on the calculated right and left clearances.

6. The sewing machine according to claim 3, wherein when a needle location of the needle corresponds to the right or left needle position, the determining section calculates a horizontal distance between a right or left end of the needle hole and the needle, and a width of the needle, based on the contour images extracted by the extracting section, and the determining section determines whether the needle location corresponds to the normal position.

7. The sewing machine according to claim 3, wherein the determining section determines calculates a right clearance between the needle and a right end of the needle hole in a case where a needle position of the needle corresponds to a right needle position and a left clearance between the needle and a left end of the needle hole in a case where the needle location of the needle corresponds to a left needle position, and the determining section determines whether the needle position is a normal position, based on the calculated right and left clearances.

8. The sewing machine according to claim 3, further comprising a warning device which is activated when the determining section has determined that the needle bar is located abnormally.

9. The sewing machine according to claim 3, further comprising a storage device which stores data of position of the needle bar corrected based on the determination of the determining section.

10. A sewing machine comprising:

a needle bar to which a needle is attached;

a needle bar rocking mechanism which rocks the needle bar;

a needle plate having a needle hole through which the needle is passed;

a button presser foot which holds a button below the needle bar;

an imaging device which images a plurality of buttonholes formed in the button;

an identifying section which identifies positions of at least two of the plural buttonholes, based on an image obtained by the imaging device;

a setting section which sets a rocking position of the needle bar so that the needle is passed through said at least two buttonholes, based on the positions of the buttonholes identified by the identifying section; and a control device which controls the needle bar rocking mechanism based on the rocking position of the needle bar set by the setting section.

11. The sewing machine according to claim 10, further comprising a detecting section which detects an interhole distance between said two buttonholes from the positions of the buttonholes identified by the identifying section, wherein the setting section sets the rocking position of the needle bar according to the interhole distance detected by the detecting section.

12. The sewing machine according to claim 10, further comprising:

a determining section which determines whether the buttonholes of the button held by the button presser foot are located at respective positions where sewing is executable; and a forbidding section which forbids a sewing operation when the determining section has determined that the buttonholes of the button are not located at the respective positions where sewing is executable.

13. The sewing machine according to claim 12, further comprising an output device which outputs a predetermined message according to a result of determination of the determining section.

14. The sewing machine according to claim 10, further comprising a display device which displays an image obtained by the imaging device.

* * * * *